US007459254B2

(12) United States Patent
Yuasa et al.

(10) Patent No.: US 7,459,254 B2
(45) Date of Patent: Dec. 2, 2008

(54) TONER AND TWO-COMPONENT DEVELOPER

(75) Inventors: Yasuhito Yuasa, Osaka (JP); Mamoru Soga, Osaka (JP); Hidekazu Arase, Hyogo (JP)

(73) Assignee: Panasonic Corporation, Osaka (JP)

( * ) Notice: Subject to any disclaimer, the term of this patent is extended or adjusted under 35 U.S.C. 154(b) by 421 days.

(21) Appl. No.: 10/580,069

(22) PCT Filed: Nov. 2, 2004

(86) PCT No.: PCT/JP2004/016261

§ 371 (c)(1),
(2), (4) Date: May 19, 2006

(87) PCT Pub. No.: WO2005/050328

PCT Pub. Date: Jun. 2, 2005

(65) Prior Publication Data

US 2007/0111124 A1 May 17, 2007

(30) Foreign Application Priority Data

Nov. 20, 2003 (JP) ..... 2003-390552

(51) Int. Cl.
*G03G 9/00* (2006.01)

(52) U.S. Cl. ..... 430/110.1; 430/110.2; 430/110.3; 430/111.3; 430/137.14

(58) Field of Classification Search ..... 430/110.1, 430/110.2, 110.3, 111.3, 137.14
See application file for complete search history.

(56) References Cited

U.S. PATENT DOCUMENTS 4,777,104 A 10/1988 Matsumoto et al.
4,996,127 A 2/1991 Hasegawa et al.
5,567,561 A 10/1996 Yoshikawa et al.
5,702,859 A 12/1997 Kubota et al.
5,766,814 A 6/1998 Baba et al.
5,849,456 A 12/1998 Matsumura et al.
5,888,687 A 3/1999 Matsumura et al.
5,910,389 A 6/1999 Matsumura et al.
5,998,078 A 12/1999 Suwabe et al.
6,080,519 A 6/2000 Ishiyama et al.
6,106,986 A 8/2000 Shirai et al.

(Continued)

FOREIGN PATENT DOCUMENTS

CN 1166626 12/1997

(Continued)

*Primary Examiner*—Hoa V Le
(74) *Attorney, Agent, or Firm*—Hamre, Schumann, Mueller & Larson, P.C.

(57) ABSTRACT

Toner includes aggregated and associated particles formed by mixing in an aqueous medium at least a resin particle dispersion in which resin particles are dispersed, a colorant particle dispersion in which colorant particles are dispersed, and a wax particle dispersion in which wax particles are dispersed and heat-treating the mixed dispersion for aggregation. The aggregated and associated particles include first particles having a capsule structure in which aggregated wax with an average particle size of greater than 1 μm is incorporated into the resin, and second particles formed of the resin and the wax in a mixed and dispersed state. The toner can achieve oilless fixing that prevents offset without using oil while maintaining high OHP transmittance and also can eliminate spent of the toner components on a carrier to make the life longer.

17 Claims, 7 Drawing Sheets

×10,000

U.S. PATENT DOCUMENTS

| | | | | |
|---|---|---|---|---|
| 6,117,607 | A | 9/2000 | Shimizu et al. | |
| 6,270,937 | B2 | 8/2001 | Yuasa et al. | |
| 6,326,116 | B2 | 12/2001 | Yuasa et al. | |
| 6,408,155 | B1 | 6/2002 | Tajima et al. | |
| 6,432,599 | B1 | 8/2002 | Yuasa et al. | |
| 6,544,707 | B2 | 4/2003 | Nakamura et al. | |
| 6,579,653 | B1 | 6/2003 | Yuasa et al. | |
| 2002/0006569 | A1* | 1/2002 | Akai et al. | 430/110.1 |
| 2002/0012863 | A1* | 1/2002 | Akai et al. | 430/110.1 |
| 2002/0042012 | A1 | 4/2002 | Mitsuhashi et al. | |
| 2002/0064401 | A1 | 5/2002 | Ashikari | |
| 2002/0064724 | A1 | 5/2002 | Nakamura et al. | |
| 2002/0086229 | A1 | 7/2002 | Yuasa et al. | |
| 2002/0127030 | A1 | 9/2002 | Yoda et al. | |
| 2003/0152856 | A1 | 8/2003 | Mizoe et al. | |

FOREIGN PATENT DOCUMENTS

| | | |
|---|---|---|
| CN | 1246659 | 3/2000 |
| CN | 1086232 | 6/2002 |
| EP | 0 606 074 | 7/1994 |
| JP | 61-80161 | 4/1986 |
| JP | 61-80162 | 4/1986 |
| JP | 61-80163 | 4/1986 |
| JP | 2619439 | 6/1989 |
| JP | 2744790 | 11/1989 |
| JP | 2-266372 | 10/1990 |
| JP | 2-271364 | 11/1990 |
| JP | 5-27476 | 2/1993 |
| JP | 5-188632 | 7/1993 |
| JP | 5-333584 | 12/1993 |
| JP | 6-89045 | 3/1994 |
| JP | 8-314184 | 11/1996 |
| JP | 10-20563 | 1/1998 |
| JP | 10-123748 | 5/1998 |
| JP | 10-198070 | 7/1998 |
| JP | 2801507 | 7/1998 |
| JP | 10301332 | 11/1998 |
| JP | 11-2922 | 1/1999 |
| JP | 11-143125 | 5/1999 |
| JP | 11-231570 | 8/1999 |
| JP | 11-327201 | 11/1999 |
| JP | 2000-10338 | 1/2000 |
| JP | 2000-267348 | 9/2000 |
| JP | 2001-209209 | 8/2001 |
| JP | 2001-249511 | 9/2001 |
| JP | 2002-6537 | 1/2002 |
| JP | 2002-14489 | 1/2002 |
| JP | 2002-23429 | 1/2002 |
| JP | 2002-148858 | 5/2002 |
| JP | 2002-229248 | 8/2002 |
| JP | 2002-229250 | 8/2002 |
| JP | 2002-278153 | 9/2002 |
| JP | 2002-296829 | 10/2002 |
| JP | 2002-311784 | 10/2002 |
| JP | 2002-341585 | 11/2002 |

* cited by examiner

TONER AND TWO-COMPONENT DEVELOPER

TECHNICAL FIELD

The present invention relates to toner and a two-component developer used, e.g., in copiers, laser printers, plain paper facsimiles, color PPC, color laser printers, color facsimiles or multifunctional devices.

BACKGROUND ART

In recent years, electrophotographic apparatuses, which commonly were used in offices, have been used increasingly for personal purposes, and there is a growing demand for technologies that can achieve, e.g., a small size, a high speed, high image quality, or high reliability for those apparatuses. Under such circumstances, a cleanerless process, a tandem color process, and oilless fixing are required along with better maintainability and less ozone emission. The cleanerless process allows residual toner from the transfer to be recycled for development without cleaning. The tandem color process enables high-speed output of color images. The oilless fixing can provide clear color images with high glossiness, transmittance, and offset resistance, even if no fixing oil is used to prevent offset during fixing. These functions should be performed simultaneously, and therefore improvements in the toner characteristics as well as the processes are important factors.

In a fixing process for color images of color printers, color toner should be melted and mixed to increase the transmittance. A melt failure of the toner may cause light scattering on the surface or the inside of the toner images, and the original color of the toner pigment is affected. Moreover, light does not reach the lower layer of the superimposed images, resulting in poor color reproduction. Therefore, it is essential for the toner to have a complete melting property and transmittance high enough not to reduce the original color. In particular, the need for light transmittance as an OHP sheet is increasing with an increase in opportunities to give a presentation using color data.

During the formation of color images, the toner may adhere to the surface of a fixing roller and cause offset. Therefore, a large amount of oil or the like should be applied to the fixing roller, which makes the handling or configuration of equipment more complicated. Thus, oilless fixing (no oil is used for fixing) is required to provide compact, maintenance-free, and low-cost equipment. To achieve the oilless fixing, e.g., the configuration of toner in which a release agent (wax) with a sharp melting property is added to a binder resin is being put to practical use.

However, such toner is very prone to a transfer failure or disturbance of the toner images during transfer because of its strong cohesiveness. Therefore, it is difficult to ensure the compatibility between transfer and fixing. In the case of two-component development, spent (i.e., the adhesion of a low-melting component of the toner to the surface of a carrier) is likely to occur by heat generated by mechanical collision or friction between the particles or between the particles and the developing unit. This decreases the charging ability of the carrier and interferes with a longer life of the developer.

Japanese patent No. 2801507 (Patent Document 1) discloses a carrier for positively charged toner that is obtained by introducing a fluorine-substituted alkyl group into a silicone resin of the coating layer. JP 2002-23429 A (Patent Document 2) discloses a coating carrier that includes conductive carbon and a cross-linked fluorine modified silicone resin. This coating carrier is considered to have high development ability in a high-speed process and maintain the development ability for a long time. While taking advantage of superior charging characteristics of the silicone resin, the conventional technique uses the fluorine-substituted alkyl group to obtain properties such as slidability, releasability and repellency, to increase resistance to wearing, peeling or cracking, and further to prevent spent. However, the resistance to wearing, peeling or cracking is not sufficient. Moreover, when the negatively charged toner is used, the amount of charge is too small, although the positively charged toner may have an appropriate amount of charge. Therefore, a significant amount of the reversely charged toner (positively charged toner) is generated, which leads to fog or toner scattering. Thus, the toner is not suitable for practical use.

Various configurations of the toner also have been proposed. It is well-known that the toner for electrostatic charge image development used in an electrophotographic method generally includes a resin component (binder resin), a coloring component (pigment or dye), a plasticizer, a charge control agent, and an additive, if necessary, such as a release agent. As the resin component, a natural or synthetic resin may be used alone or in combination. After the additive is pre-mixed in an appropriate ratio, the mixture is heated and kneaded by thermal melting, pulverized by an air stream collision board system, and classified as fine powders, thus producing a toner base. In this case, the toner base also may be produced by a chemical polymerization method. Then, an additive such as hydrophobic silica is added to the toner base, so that the toner is completed. The single component development typically uses the toner only, while the two-component development uses a developer including the toner and a carrier of magnetic particles.

Even with pulverization and classification of the conventional kneading and pulverizing processes, the actual particle size can be reduced to only about 8 μm in view of the economic and performance conditions. At present, various methods are considered to produce toner having a smaller particle size. In addition, a method for achieving the oilless fixing also is considered, e.g., by adding a release agent (wax) to the resin with a low softening point during melting and kneading. However, there is a limit to the amount of wax that can be added, and increasing the amount of wax can cause problems such as low flowability of the toner, transfer voids, a fusion of the toner to a photoconductive member, or spent of the toner component on the carrier.

Therefore, various ways of polymerization different from the kneading and pulverizing processes have been studied as a method for producing toner.

JP 10(1998)-198070 (Patent Document 3) discloses a process of preparing a liquid mixture by mixing at least a resin particle dispersion in which resin particles are dispersed in a surface-active agent having a polarity and a colorant particle dispersion in which colorant particles are dispersed in a surface-active agent having a polarity. The surface-active agents included in the liquid mixture have the same polarity, so that toner for electrostatic charge image development with high reliability and excellent charge and color development properties can be produced in a simple and easy manner.

JP 10(1998)-301332 (Patent Document 4) discloses that the release agent includes at least one kind of ester composed of at least one selected from higher alcohol having a carbon number of 12 to 30 and higher fatty acid having a carbon number of 12 to 30, and the resin particles include at least two kinds of resin particles with different molecular weights. This can provide toner with an excellent fixing property, color development property, transparency, and color mixing property.

As the release agent, e.g., low molecular-weight polyolefins such as polyethylene, polypropylene and polybutene, silicones, fatty acid amides such as oleamide, erucamide, amide ricinoleate and amide stearate, vegetable waxes such as carnauba wax, rice wax, candelilla wax, Japan wax and jojoba oil, animal waxes such as beeswax, mineral/petroleum waxes such as montan wax, ozocerite, ceresin, paraffin wax, microcrystalline wax and Fischer-Tropsch wax, and modified materials thereof are disclosed.

However, when the dispersibility of the release agent added is lowered, the toner images melted during fixing are prone to have a dull color. This also decreases the pigment dispersibility, and thus the color development property of the toner becomes insufficient. In the subsequent process, when resin fine particles further adhere to the surface of an aggregate, the adhesion of the resin fine particles is unstable due to low dispersibility of the release agent or the like. Moreover, the release agent that once was aggregated with the resin is liberated into an aqueous medium. Depending on the polarity or the thermal properties such as a melting point, the release agent may have a considerable effect on aggregation.

Further, a specified wax is added in a large amount to achieve the oilless fixing. Therefore, it is difficult to aggregate the wax with the resin that differs from the wax in melting point, softening point and viscoelasticity, and to fuse them together uniformly by heating. In particular, the use of a release agent having a predetermined acid value and a functional group may achieve the oilless fixing, reduce fog in the development, and improve the transfer efficiency. However, such a release agent prevents uniform mixing and aggregation of the resin particles with pigment particles in an aqueous medium during manufacture. Thus, there is a tendency to increase the presence of pigment as well as the release agent that are not aggregated but suspended in the aqueous medium.

There is a limit of several hundred nanometers to the particle size the release agent or the like can have by using a emulsifying and dispersing device such as a homogenizer. To achieve a smaller particle size and a uniform particle size distribution of the toner, the release agent itself is required to form a fine particle dispersion. However, the particle size distribution of the dispersion becomes an important factor. Even if the particles size of the release agent is made finer, coarse particles are not either mixed or aggregated with the resin dispersion and the pigment dispersion, but remain suspended and exist independently, while small particles are likely to adhere to the stirring shaft or the wall surface during melting, thus resulting in low productivity.

Patent Document 1: Japanese Patent No. 2801507
Patent Document 2: JP 2002-23429 A
Patent Document 3: JP 10(1998)-198070A
Patent Document 4: JP 10(1998)-301332 A

DISCLOSURE OF INVENTION

Therefore, with the foregoing in mind, it is an object of the present invention to provide toner that can have a smaller particle size and a sharp particle size distribution without requiring a classification process. It is another object of the present invention to perform oilless fixing (no oil is applied to a fixing roller) by using the toner to which wax is added while achieving low-temperature fixability, high-temperature offset resistance, and storage stability. It is yet another object of the present invention to provide a two-component developer that can have a long life and high resistance to deterioration caused by spent, even if it is combined with the toner to which wax is added. It is still another object of the present invention to provide an image forming apparatus that can suppress transfer voids or scattering during transfer and ensure high transfer efficiency. The present invention also has an object of providing toner and a two-component developer that can solve the above problems comprehensively and satisfactorily.

Toner of the present invention includes aggregated and associated particles formed by mixing in an aqueous medium at least a resin particle dispersion in which resin particles are dispersed, a colorant particle dispersion in which colorant particles are dispersed, and a wax particle dispersion in which wax particles are dispersed and heat-treating the mixed dispersion for aggregation. The aggregated and associated particles include first particles having a capsule structure in which aggregated wax with an average particle size of greater than 1 μm is incorporated into the resin, and second particles formed of the resin and the wax in a mixed and dispersed state.

A two-component developer of the present invention includes a toner base, an additive, and a carrier. The toner base includes aggregated and associated particles formed by mixing in an aqueous medium at least a resin particle dispersion in which resin particles are dispersed, a colorant particle dispersion in which colorant particles are dispersed, and a wax particle dispersion in which wax particles are dispersed and heat-treating the mixed dispersion for aggregation. The toner base includes first particles having a capsule structure in which aggregated wax with an average particle size of greater than 1 μm is incorporated into the resin, and second particles formed of the resin and the wax in a mixed and dispersed state. The additive is inorganic fine powder with an average particle size of 6 nm to 200 nm, and 1.0 to 6 parts by weight of the inorganic fine powder are added to 100 parts by weight of the toner base. The carrier includes magnetic particles as a core material, and at least the surface of the core material is coated with a fluorine modified silicone resin containing an aminosilane coupling agent.

Figure 1:
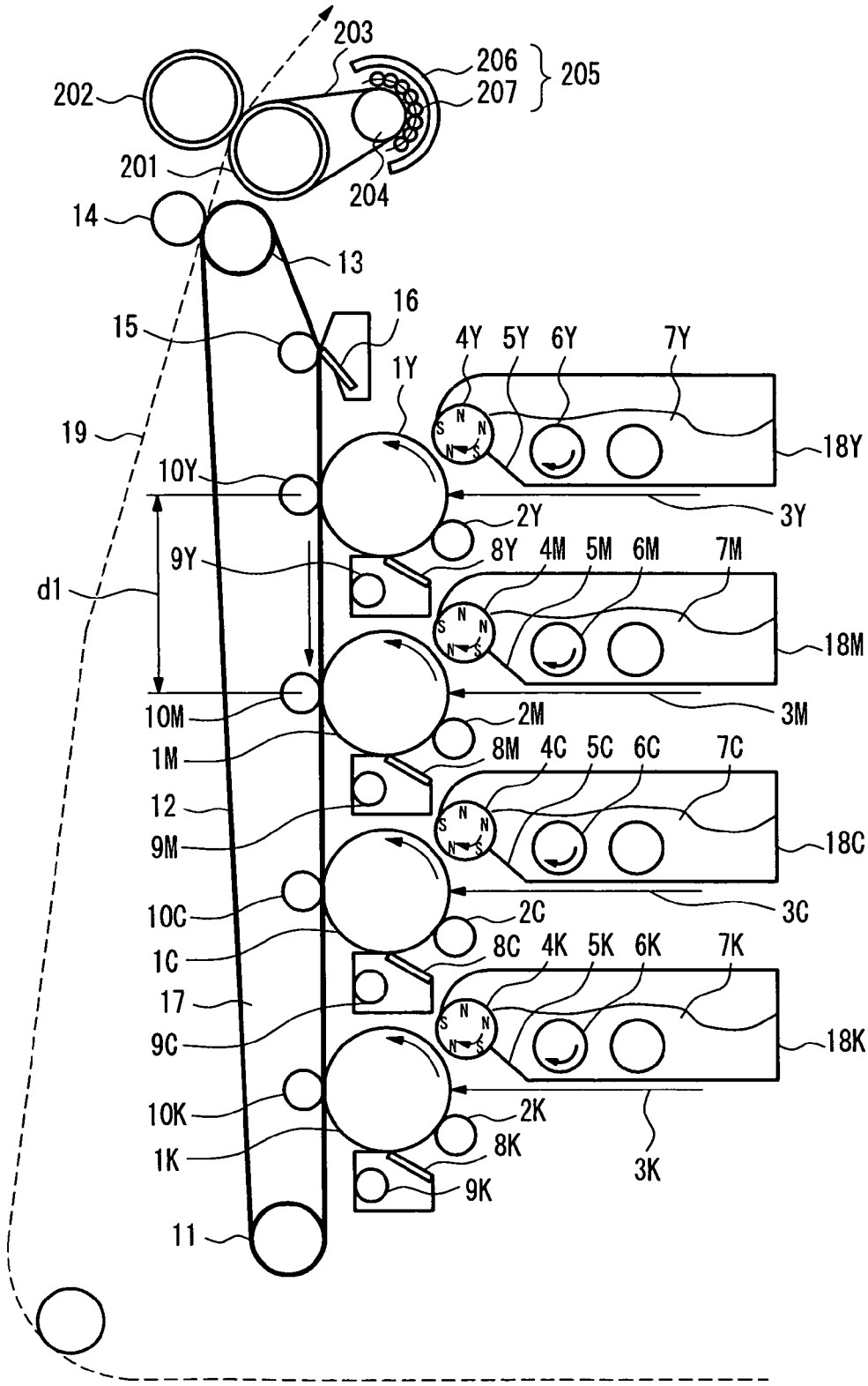
FIG. 1 is a cross-sectional view showing the configuration of an image forming apparatus used in an example of the present invention.

1: photoconductive member, 2: charging roller, 3: laser signal light, 4: developing roller, 5: blade, 10: first transfer roller, 12: transfer belt, 14: second transfer roller, 13: driving tension roller, 17: transfer belt unit, 18K, 18C, 18M, 18Y: image forming units, 18: image forming unit group, 201: fixing roller, 202: pressure roller, 203: fixing belt, 205: induction heater

BEST MODE FOR CARRYING OUT THE INVENTION

In the present invention, the toner base is produced by mixing in an aqueous medium a resin particle dispersion in which resin particles are dispersed, a colorant particle dispersion in which colorant particles are dispersed, and a wax particle dispersion in which wax particles are dispersed and heat-treating the mixed dispersion for aggregation. Accordingly, it is possible to reduce the presence of pigment as well as wax that are not aggregated but suspended in the aqueous medium. The toner can have a smaller particle size and a uniform, narrow, and sharp particle size distribution without requiring a classification process. Moreover, oilless fixing can be achieved at low temperatures while preventing offset without using oil. The two-component developer can have high resistance to deterioration caused by spent, even if it is combined with the toner incorporating wax. In the tandem color process, a plurality of image forming stations, each of which includes a photoconductive member and a developing unit, are arranged, and the transfer process is performed by successively transferring each color of toner to a transfer member. This can suppress transfer voids or reverse transfer and ensure high transfer efficiency.

The present inventors conducted a detailed study of providing i) toner for electrostatic charge image development that has a smaller particle size and a sharp particle size distribution and can achieve not only the oilless fixing but also superior glossiness, transmittance, charging characteristics, environmental dependence, cleaning property and transfer property; ii) a two-component developer using the toner; and ii) image formation that can form color images with high quality and reliability without causing toner scattering, fog, or the like.

(1) Polymerization Process

A resin particle dispersion is prepared by forming resin particles of a homopolymer or copolymer (vinyl resin) of vinyl monomers by emulsion or seed polymerization of the vinyl monomers in an ionic surface-active agent and dispersing the resin particles in the ionic surface-active agent. Any known dispersing devices such as a high-speed rotating emulsifier, a high-pressure emulsifier, a colloid-type emulsifier, and a ball mill, a sand mill, and Dyno mill that use a medium can be used.

When the resin particles are made of resin other than the homopolymer or copolymer of the vinyl monomers, a resin particle dispersion may be prepared in the following manner. If the resin dissolves in an oil solvent that has a relatively low water solubility, a solution is obtained by mixing the resin with the oil solvent. The solution is blended with an ionic surface-active agent or polyelectrolyte, and then is dispersed in water to produce a fine particle dispersion by using a dispersing device such as a homogenizer. Subsequently, the oil solvent is evaporated by heating or under reduced pressure. Thus, the resin particles made of resin other than the vinyl resin are dispersed in the ionic surface-active agent.

Examples of a polymerization initiator include azo- or diazo-based initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

A colorant particle dispersion is prepared by adding colorant particles to water that includes a surface-active agent having a polarity and dispersing the colorant particles using the above dispersing device.

The toner of this embodiment includes wax. In the toner of this embodiment, the resin particle dispersion, the colorant particle dispersion, and the wax particle dispersion are mixed and aggregated in an aqueous medium, and then is heat-treated to form aggregated and associated particles, thus providing a toner base.

It is preferable that the aggregated and associated particles include at least first particles having a capsule structure in which aggregated wax with an average particle size of greater than 1 μm is incorporated into the resin, and second particles formed of the resin and the wax in the mixed and dispersed state.

The toner may be produced by adding a resin particle dispersion in which resin particles for forming a shell are dispersed to the dispersion in which the aggregated and associated particles are dispersed and heat-treating the mixture so that the resin particles for forming a shell are fused with the aggregated and associated particles to form fused particles. In the fused particles, the surfaces of the aggregated and associated particles may be covered with at least 0.1 μm thick coating of the resin particles for forming a shell. The fused particles also may include the first particles having a capsule structure in which aggregated wax with an average particle size of greater than 1 μm is incorporated into the resin, and the second particles formed of the resin and the wax in the mixed and dispersed state. The proportion of the second particles in the aggregated and associated particles is preferably not less than 50% by number, and more preferably 50% to 80% by number.

Figure 7:
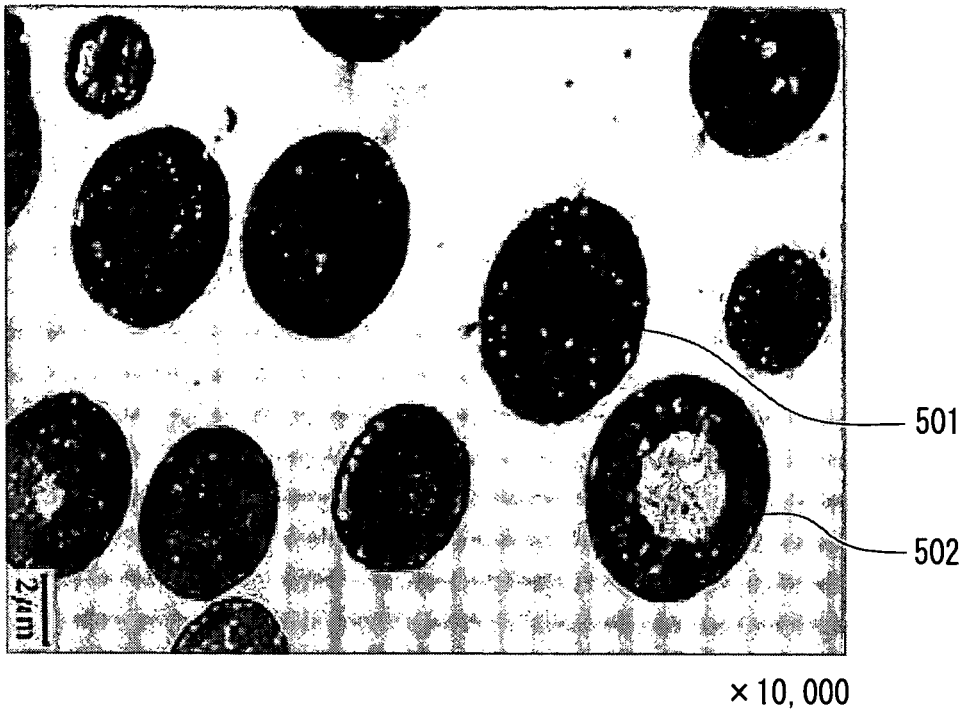
FIG. 7 shows a transmission electron microscope (TEM) cross-sectional image of fused particles in an example of the present invention.
Figure 8:
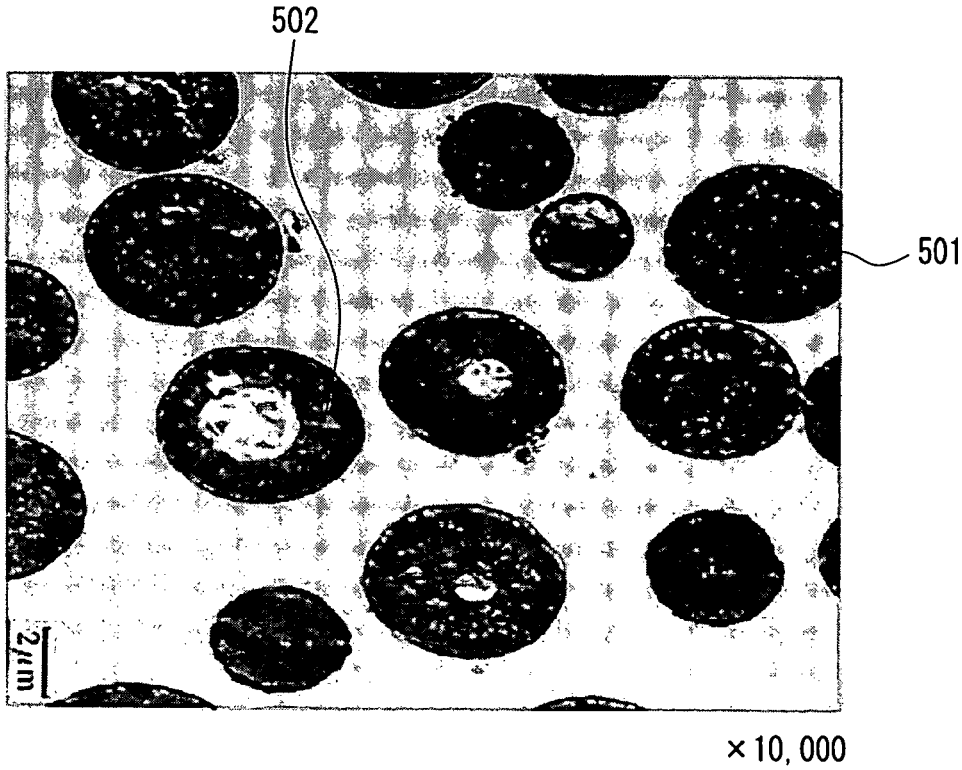
FIG. 8 shows a TEM cross-sectional image of fused particles in an example of the present invention.

FIGS. 7, 8, 9, 10, and 11 show transmission electron microscope (TEM) cross-sectional images of the particles. The TEM used in this embodiment was H-800 (accelerating voltage: 100 kV) manufactured by Hitachi, Ltd. The sample was stained with ruthenate (0.2% aqueous solution) for 5 minutes to clarify the phase separation structure inside. Then, the sample was embedded in a room temperature curing epoxy resin, and the cross section of the sample was observed by the TEM with ultrasectioning. In FIGS. 7 and 8, reference numeral 501 denotes the second particles formed of the resin and the wax in the mixed and dispersed state, and 502 denotes the first particles having a capsule structure in which the wax is incorporated into the resin. It can be seen from FIGS. 9 and 10 that the resin, the wax, and the colorant are mixed and dispersed to form particles whose outline is blurred (also referred to as the mixing and dispersing state in the following), and the shell resin is fused around each of the particles, represented by a region that appears uniform in the images. That is, the second particles 501 include a layer 504 composed of the resin and the wax in the mixed and dispersed state and a layer 503 composed of the fused shell resin.

Figure 11:
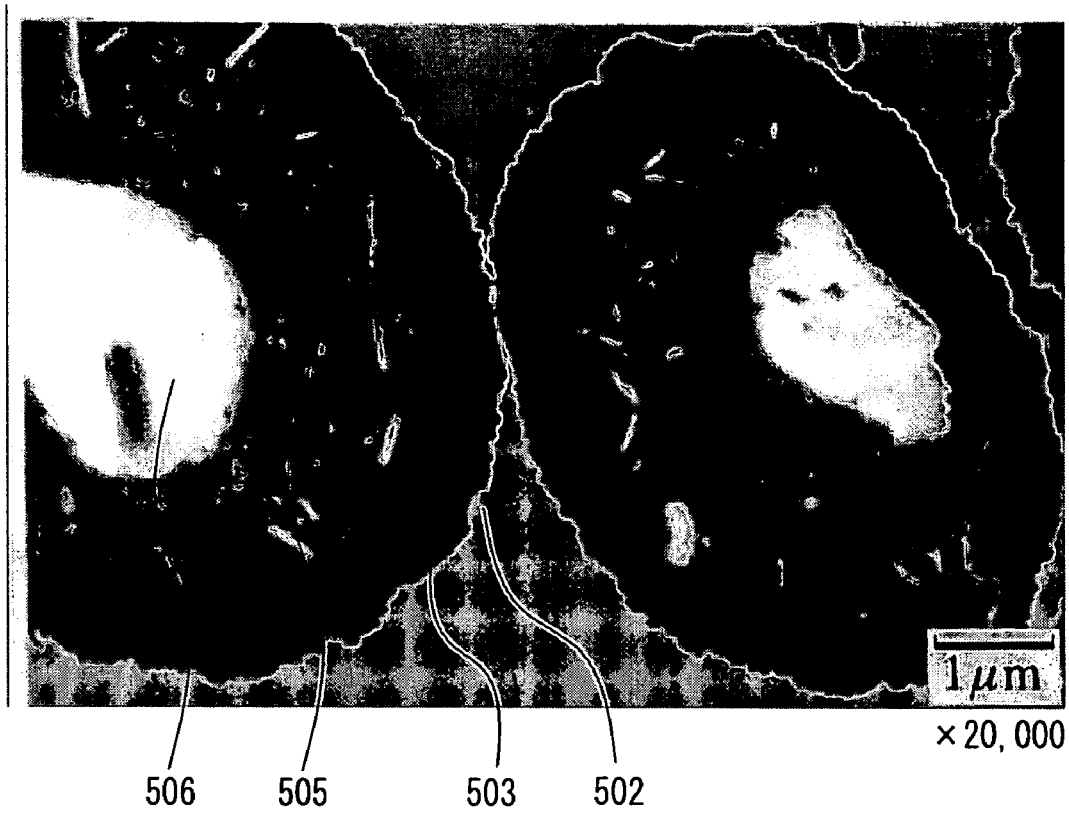
FIG. 11 shows a TEM cross-sectional image of fused particles in a comparative example of the present invention.

In FIG. 11, reference numeral 502 denotes the first particles, 506 denotes the wax gathered and incorporated into the resin, which appears white in the center of the first particles, 505 denotes a layer composed of the resin and the colorant, and 503 denotes a layer composed of the fused shell resin. In FIG. 11, the black thin film that seems an outermost shell results from staining to make the boundary clearer for TEM observation and thus is irrelevant to the toner.

Figure 9:
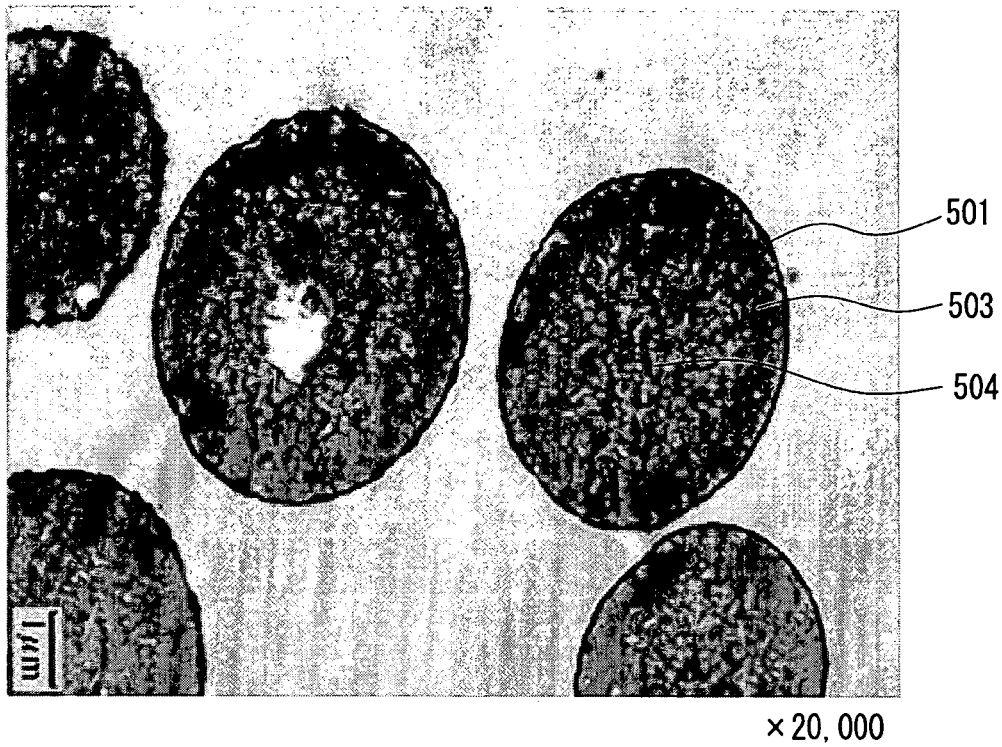
FIG. 9 shows a TEM cross-sectional image of fused particles in an example of the present invention.
Figure 10:
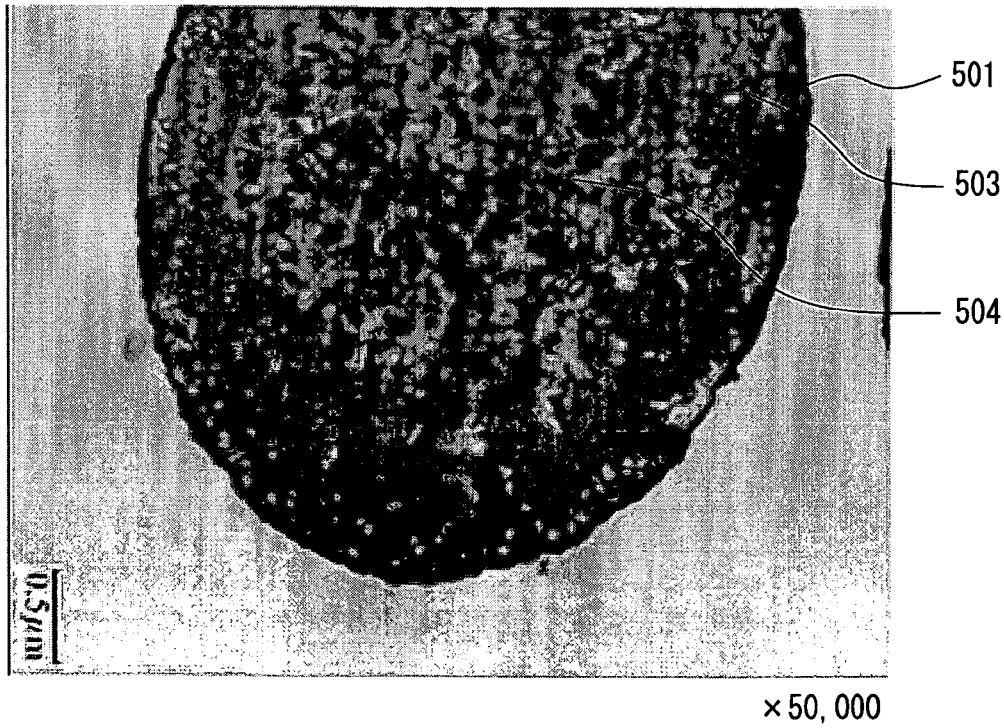
FIG. 10 shows a TEM cross-sectional image of fused particles in an example of the present invention.

FIGS. 7 and 8 show the fused particles including the first particles and the second particles. In FIG. 7, most of the particles are the second particles. In FIG. 8, about 60% of the particles are the second particles. FIG. 9 is a partially enlarged view of FIG. 7.

The proportion was determined by selecting 100 particles with a particle size of ±1 μm of the volume-average particle size of toner in the TEM observation image.

The second particles preferably account for more than half of the aggregated and associated particles. This decreases the softening point and can provide the effect of improving the low-temperature fixability, e.g., by preventing cold offset at low temperatures and reinforcing the fixing strength, even if the amount of wax is reduced. Moreover, the resin particles for forming a shell are fused with the aggregated and associated particles, which also can provide the effect of improving the storage stability. When the proportion of the second particles is less than 50% by number, it is difficult to improve both the low-temperature fixability and the storage stability.

The first particles have a capsule structure in which the wax is incorporated into the resin. This is effective for improving the high-temperature offset resistance and the separability of a paper in fixing. However, if the proportion of the first particles is too large, it will pose a problem of the storage stability. As a result of the storage stability test, although each particle was covered with a hard resin layer, the inside of the particles was melted and solidified easily by thermal aggregation. Moreover, there is no advantage for the low-temperature fixability.

When the wax contained in the first particles is aggregated to a size of 1 μm or more, the storage stability is likely to be degraded. Therefore, it is preferable that the proportion of the second particles is less than 50% by number. It is more preferable that the proportion is more than 20% by number so that the effect of improving the high-temperature offset resistance and the separability of a paper in fixing can be more prominent.

When the resin and the wax in the mixed and dispersed state of the second particles have a size of 1 μm or less, and preferably 0.5 μm or less, the low-temperature fixability and the storage stability can be improved.

In the fused particles, the surfaces of the aggregated and associated particles may be covered with at least 0.1 μm thick coating of the resin particles for forming a shell. This improves the durability of the toner and can provide the effect of improving the high-temperature offset resistance.

The mixing and dispersing state can be produced depending on the melting point and composition of the wax, the Tg (glass transition point), softening point, and composition of the resin, and the aggregation conditions.

The toner base is produced by mixing the resin particle dispersion, the colorant particle dispersion, and the wax particle dispersion in an aqueous medium, adjusting the pH of the aqueous medium under predetermined conditions, and aggregating and associating the particles by heating the aqueous medium at temperatures not less than the melting point (i.e., the endothermic peak temperature Tmw based on a DSC method) of the wax in the presence of an inorganic salt. In this case, the heating temperature is controlled so as not to exceed Tmw+15° C. The glass transition point Tg of the resin is preferably at least 10° C., more preferably at least 20° C., and further preferably at least 30° C. lower than the melting point of the wax.

Specifically, the heating temperature of the aqueous medium is in the range of the melting point Tmw of the wax to Tmw+15° C. The pH of the aqueous medium is adjusted with 1N NaOH to 8 or more, and preferably 8 to 13. When the pH is more than 13, the particles are not aggregated, and therefore a uniform particle size distribution of aggregated particles cannot be achieved. When the pH is less than 8, the aggregation proceeds excessively, and the particle size is increased considerably. When the temperature of the aqueous medium is lower than Tmw, the aggregation does not proceed uniformly, and the particles cannot be formed successfully. When it is higher than Tmw+15° C., the aggregation proceeds excessively, and the particle size is increased considerably. Thus, the mixing and dispersing state cannot be produced easily.

Thereafter, the temperature of the aqueous medium is raised further by at least 5° C., and the aqueous medium is heated for a predetermined time (1 to 5 hours), thus producing a toner base having a sharp particle size distribution of the aggregated and associated particles in which the wax is incorporated into the resin, and the resin and the wax are in the mixed and dispersed state.

Before increasing the temperature of the aqueous medium by 5° C. or more, the pH of the mixed dispersion may be adjusted to 6 or less. The thermal stimulation caused by a temperature rise of 5° C. or more improves the uniformity of the particle surface, so that the subsequent adhesion and fusion of the resin particles for forming a shell can be performed stably. Moreover, secondary aggregation of the aggregated and associated particles can be suppressed by adjusting the pH to 6 or less, and the particles can have a sharper particle size distribution due to the thermal stimulation. Under these conditions, it is possible to form the aggregated and associated particles that include the second particles formed of the resin and the wax in the mixed and dispersed state in a proportion of at least 50% by number.

On the other hand, the proportion of the first particles in which the wax is incorporated into the resin can be increased by controlling the relationship between the Tg of the resin and the melting point of the wax, the treatment temperature of the aqueous medium, and the pH value.

Specifically, it is preferable that the Tg of the resin is up to 20° C. lower than the melting point of the wax. More preferably, the Tg of the resin is 5° C. to 15° C. lower than the melting point of the wax. Further preferably, the Tg of the resin is 5° C. to 10° C. lower than the melting point of the wax.

Alternatively, it is preferable that the aqueous medium is treated at temperatures at least 15° C. higher than the Tmw (the melting point) of the wax. In this case, the pH of the aqueous medium may be adjusted to 11 or more. Since the temperature of the aqueous medium is increased, the aggregation proceeds excessively and the particles become coarser if the pH is not adjusted.

The first particles and the second particles may be formed separately in the above manner, and then mixed at a predetermined ratio.

The toner base may be produced by mixing the dispersion in which the aggregated and associated particles are dispersed and a resin particle dispersion in which resin particles for forming a shell are dispersed and fusing the resin particles for forming a shell with the aggregated and associated particles. The toner base thus obtained has a volume-average particle size of 3 to 7 μm and a coefficient of variation of 25 or less.

After the aggregated particle dispersion is mixed with the resin particle dispersion for forming a shell, a water-soluble inorganic salt may be added, and the aqueous medium may be heated at 70° C. to 90° C. for about 0.5 to 2 hours so that the resin particles adhere to the surfaces of the aggregated and associated particles. Subsequently, the pH may be reduced to 6 or less with 1N HCl, and a fusion treatment may be performed by heating the aqueous medium at 80° C. or more, and preferably 90° C. or more for 1 to 8 hours. By reducing the pH to 6 or less, the resin particles that have adhered to the surfaces of the aggregated and associated particles can be fused while avoiding secondary aggregation of the aggregated and associated particles. Thus, smaller particles having a more uniform particle size distribution can be formed.

Before mixing the aggregated particle dispersion and the resin particle dispersion for forming a shell, the pH of the aggregated particle dispersion may be adjusted to 8 or more, and preferably 8 to 13. When the pH is more than 13, the resin particles are not likely to adhere to the surfaces of the aggregated and associated particles, and therefore a uniform particle size distribution of aggregated particles cannot be achieved. When the pH is less than 8, the adhesion proceeds excessively, and the particle size is increased considerably.

After the pH has been adjusted to 8 or more, and the aggregated particle dispersion is mixed with the resin particle dispersion for forming a shell, a water-soluble inorganic salt may be added, and the aqueous medium may be heated at 70° C. to 90° C. for about 0.5 to 2 hours so that the resin particles adhere to the surfaces of the aggregated and associated particles. Subsequently, the pH may be reduced to 6 or less with 1N HCl, and a fusion treatment may be performed by heating the aqueous medium at 80° C. or more, and preferably 90° C. or more for 1 to 8 hours.

The thickness of the shell resin of the fused particles, i.e., the resin particles adhering to the surfaces of the aggregated and associated particles is preferably not less than 0.1 μm, more preferably 0.1 to 3 μm, further preferably 0.5 to 3 μm, and most preferably 1 to 3 μm. When the thickness is less than 0.1 μm, the adhesion of the shell resin becomes poor, and the shell resin itself lacks strength due to the influence of moisture. When the thickness is more than 3 μm, the fixability and the glossiness are reduced.

As the inorganic salt, e.g., an alkali metal salt and an alkaline-earth metal salt may be used. Examples of the alkali metal include lithium, potassium, and sodium. Examples of the alkaline-earth metal include magnesium, calcium, strontium, and barium. Among these, potassium, sodium, magnesium, calcium, and barium are preferred. The counter ions (the anions constituting a salt) of the above alkali metals or alkaline-earth metals may be, e.g., a chloride ion, bromide ion, iodide ion, carbonate ion, or sulfate ion.

Examples of the organic solvent with infinite solubility in water include methanol, ethanol, 1-propanol, 2-propanol, ethylene glycol, glycerin, and acetone. Among these, alcohols having a carbon number of not more than 3 such as methanol, ethanol, 1-propanol, and 2-propanol are preferred, and 2-propanol is particularly preferred.

Thereafter, cleaning, liquid-solid separation, and drying processes may be performed as desired to provide toner. The cleaning process preferably involves sufficient substitution cleaning with ion-exchanged water to improve the chargeability. The liquid-solid separation process is not particularly limited, and any known filtration methods such as suction filtration and pressure filtration can be used preferably in view of productivity. The drying process is not particularly limited, and any known drying methods such as flash-jet drying, flow drying, and vibration-type flow drying can be used preferably in view of productivity.

As the surface-active agent having a polarity, e.g., an aqueous medium containing a polar surface-active agent may be used. Examples of the aqueous medium include water such as distilled water or ion-exchanged water, and alcohols. They can be used individually or in combinations of two or more. The content of the polar surface-active agent need not be defined generally and may be selected appropriately depending on the purposes.

As the polar surface-active agent, e.g., a sulfate-based, sulfonate-based, phosphate-based, or soap-based anionic surface-active agent or an amine salt-type or quaternary ammonium salt-type cationic surface-active agent may be used.

Specific examples of the anionic surface-active agent include sodium dodecyl benzene sulfonate, sodium dodecyl sulfate, sodium alkyl naphthalene sulfonate, and sodium dialkyl sulfosuccinate. Specific examples of the cationic surface-active agent include alkyl benzene dimethyl ammonium chloride, alkyl trimethyl ammonium chloride, and distearyl ammonium chloride. They can be used individually or in combinations of two or more.

In the present invention, these polar surface-active agents can be used together with a nonpolar surface-active agent. As the nonpolar surface-active agent, e.g., a polyethylene glycol-based, alkylphenol ethylene oxide adduct-based, or polyhydric alcohol-based nonionic surface-active agent may be used.

The wax having a low melting point should be mixed and dispersed uniformly so as not to be liberated or suspended during mixing and aggregation. This may be affected significantly by the particle size distribution, composition, and melting property of the wax.

For the resin particles including a styrene-acryl copolymer, ester wax is more suitable than vinyl wax such as polypropylene or polyethylene. The ester wax does not become liberated or suspended during mixing and aggregation and can be mixed and dispersed uniformly. Therefore, the influence of the liberated wax can be removed to suppress spent of the toner on a carrier or filming of the toner on OPC or a transfer belt. Moreover, it is possible to prevent transfer voids or reverse transfer effectively.

The wax particle dispersion may be prepared in such a manner that wax is mixed in an aqueous medium (e.g., ion-exchanged water) including the surface-active agent having a polarity, and then is heated, melted, and dispersed.

In this case, the wax may be emulsified and dispersed so that the particle size is 20 to 200 nm for 16% diameter (PR16), 40 to 300 nm for 50% diameter (PR50), not more than 400 nm for 84% diameter (PR84), and PR84/PR16 is 1.2 to 2.0 in a cumulative volume particle size distribution obtained by accumulation from the smaller particle diameter side. It is preferable that the particles having a diameter not greater than 200 nm is 65 vol % or more, and the particles having a diameter of greater than 500 nm is 10 vol % or less.

Preferably, the particle size may be 20 to 100 nm for 16% diameter (PR16), 40 to 160 nm for 50% diameter (PR50), not more than 260 nm for 84% diameter (PR84), and PR84/PR16 is 1.2 to 1.8 in the cumulative volume particle size distribution obtained by accumulation from the smaller particle diameter side. It is preferable that the particles having a diameter not greater than 150 nm is 65 vol % or more, and the particles having a diameter greater than 400 nm is 10 vol % or less.

More preferably, the particle size may be 20 to 60 nm for 16% diameter (PR16), 40 to 120 nm for 50% diameter (PR50), not more than 220 nm for 84% diameter (PR84), and PR84/PR16 is 1.2 to 1.8 in the cumulative volume particle size distribution obtained by accumulation from the smaller particle diameter side. It is preferable that the particles having a diameter not greater than 130 nm is 65 vol % or more, and the particles having a diameter greater than 300 nm is 10 vol % or less.

When the resin particle dispersion, the colorant particle dispersion, and the wax particle dispersion are mixed to form aggregated particles, the wax with a particle size of 20 to 200 nm for 16% diameter (PR16) can be dispersed finely and incorporated easily into the resin particles. Therefore, it is possible to prevent aggregation of the wax particles themselves that are not aggregated with the resin particles and the colorant particles, to achieve uniform dispersion, and to eliminate the suspended particles in the aqueous medium. The mixing and dispersing state can be produced easily.

When the particle size is more than 200 nm for PR16, more than 300 nm for PR50, and more than 400 nm for PR84, PR84/PR16 is more than 2.0, the particles having a diameter not greater than 200 nm is less than 65 vol %, and the particles having a diameter greater than 500 nm is more than 10 vol %, the wax particles are not incorporated easily into the resin particles and thus are prone to aggregation by themselves. Therefore, a large number of particles that are not incorporated into the resin particles are likely to be suspended in the aqueous medium. Moreover, the amount of wax that is exposed on the surfaces of the aggregated particles and liberated therefrom is increased while further resin particles are fused. This may increase filming of the toner on a photoconductive member or spent of the toner on a carrier, reduce the handling property of the toner in a developing unit, and cause a developing memory.

When the particle size is less than 20 nm for PR16 and less than 40 nm for PR50, and PR84/PR16 is less than 1.2, it is difficult to maintain the dispersion state, and reaggregation of the wax occurs during the time it is allowed to stand, so that the standing stability of the particle size distribution can be degraded. Moreover, the load and heat generation are increased while the particles are dispersed, thus reducing productivity.

When the particle size for 50% diameter (PR50) of the wax dispersed in the wax particle dispersion is smaller than the particle size for 50% diameter (PR50) of the resin particles in forming the aggregated particles, the wax can be incorporated easily into the resin particles. Therefore, it is possible to prevent aggregation of the wax particles themselves that are not aggregated with the resin particles and the colorant particles, to achieve uniform dispersion, and to eliminate the suspended particles in the aqueous medium. Moreover, when the aggregated particles are heated and melted in the aqueous medium to form aggregated and associated particles, the mixing and dispersing state can be produced easily. It is more preferable that the particle size for 50% diameter (PR50) of the wax is at least 20% smaller than that of the resin particles.

The wax particles can be dispersed finely in the following manner. A wax melt in which the wax is melted at a concentration of not more than 40 wt % is emulsified and dispersed into a medium that includes a surface-active agent and is maintained at temperatures not less than the melting point of the wax by utilizing the effect of a strong shearing force generated when a rotating body rotates at high speed relative to a fixed body with a predetermined gap between them.

Figure 3:
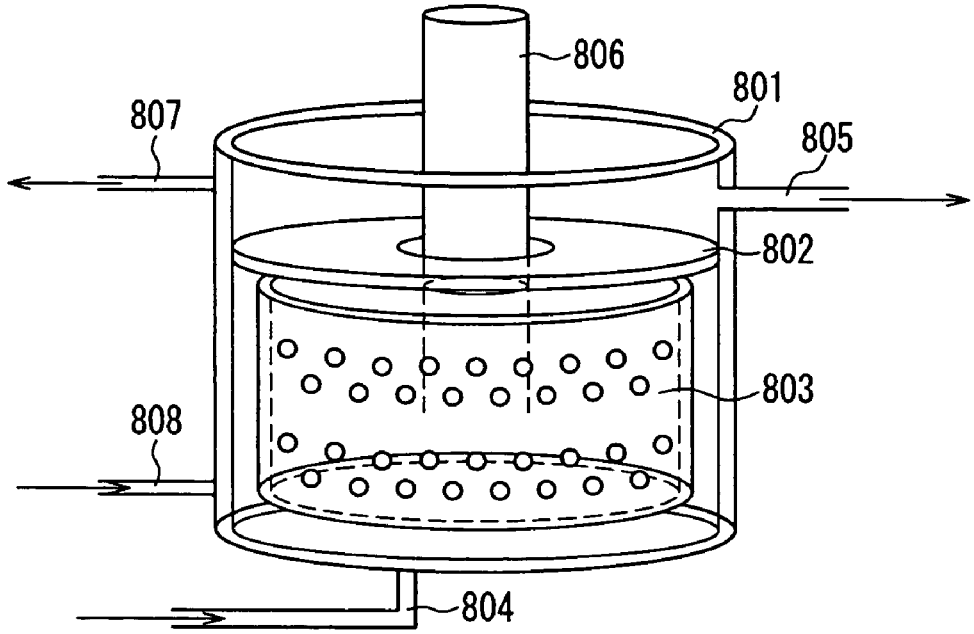
FIG. 3 is a schematic view showing a stirring/dispersing device used in an example of the present invention.
Figure 4:
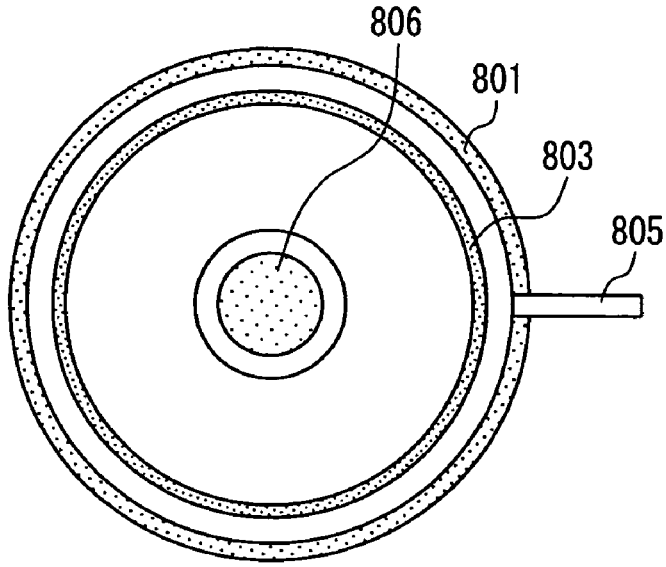
FIG. 4 is a plan view of the stirring/dispersing device in FIG. 3.

As shown in FIG. 3 or 4, e.g., a rotating body may be placed in a tank having a certain capacity so that there is a gap of about 0.1 mm to 10 mm between the side of the rotating body and the tank wall. The rotating body rotates at a high speed of not less than 30 m/s, preferably not less than 40 m/s, and more preferably not less than 50 m/s and exerts a strong shearing force on the liquid, thus producing an emulsified dispersion with a finer particle size. A 30-second to 5-minute treatment may be enough to obtain the fine dispersion.

Figure 5:
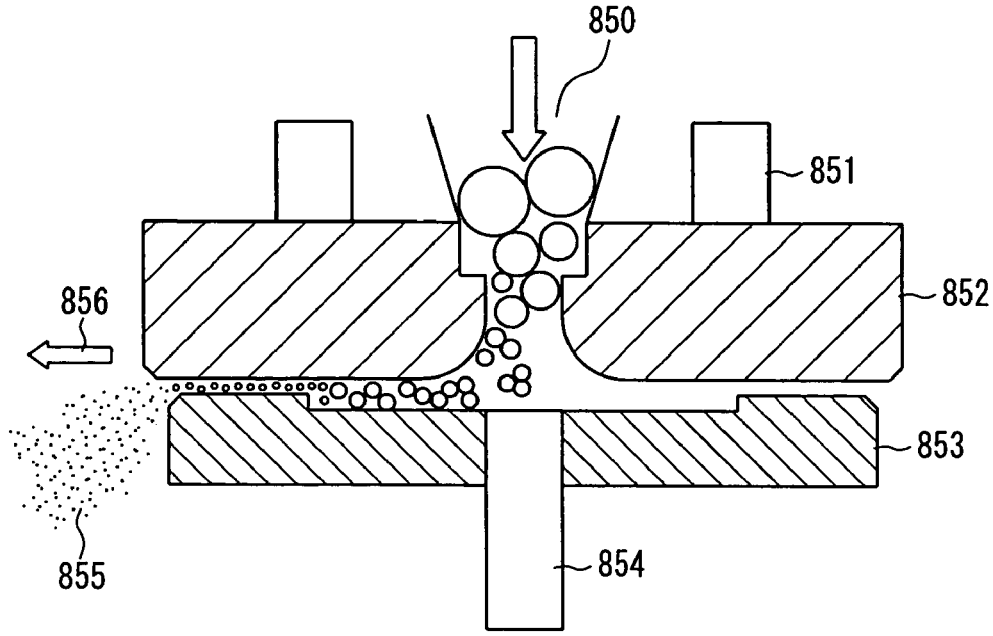
FIG. 5 is a schematic view showing a stirring/dispersing device used in an example of the present invention.
Figure 6:
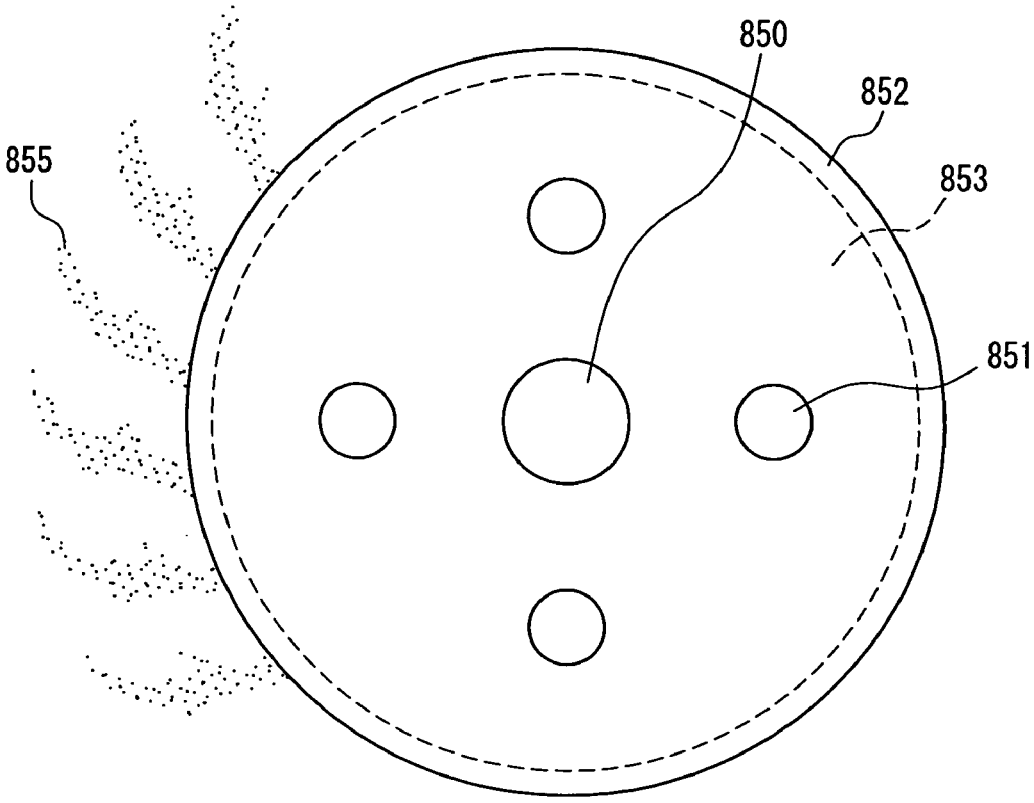
FIG. 6 is a plan view of the stirring/dispersing device in FIG. 5.

As shown in FIG. 5 or 6, e.g., a rotating body may rotate at a speed of not less than 30 m/s, preferably not less than 40 m/s, and more preferably not less than 50 m/s relative to a fixed body, while a gap of about 1 to 100 μm is kept between them. This configuration also can provide the effect of a strong shearing force, thus producing a fine dispersion.

In this manner, it is possible to form a narrower and sharper particle size distribution of the fine particles than using a high-pressure dispersing device such as a high-pressure homogenizer. It is also possible to maintain a stable dispersion state without causing any reaggregation of the fine particles in the dispersion even when left standing for a long time. Thus, the standing stability of the particle size distribution can be improved.

When the wax has a high melting point, it may be heated under high pressure to form a melt. Alternatively, the wax may be dissolved in an oil solvent. This solution is blended with a surface-active agent or polyelectrolyte and dispersed in water to make a fine particle dispersion by using either of the dispersing devices as shown in FIGS. 3 to 6, and then the oil solvent is evaporated by heating or under reduced pressure.

The particle size can be measured, e.g., by using a laser diffraction particle size analyzer LA920 (manufactured by Horiba, Ltd.) or SALD2100 (manufactured by Shimadzu Corporation).

(2) Wax

Ester wax is suitable for the wax added to the toner of this embodiment. The wax preferably has an iodine value of not more than 25 and a saponification value of 30 to 300. This wax can relieve the repulsion caused by the charging action of the toner during multilayer transfer and also can suppress a reduction in transfer efficiency, transfer voids, or reverse transfer. By combining the wax with a carrier (which will be described later), it is possible to suppress the occurrence of spent on the carrier. Accordingly, the life of a developer can be made longer. Further, the handling property of the toner in a developing unit can be improved, so that the image uniformity can be improved at both the start and end of the development. The generation of a developing memory also can be reduced. Moreover, the mixing and dispersing state can be produced easily. When the iodine value of the wax is more than 25, the mixing and aggregation of the wax in the aqueous medium become poor, and uniform dispersibility is decreased to cause a dull color. Moreover, suspended solids are increased and remain in the toner, which may lead to filming of the toner on a photoconductive member or the like. This makes it difficult to relieve the repulsion caused by the charging action of the toner during multilayer transfer in the primary transfer process. The environmental dependence is large, and a change in chargeability of the material is increased and impairs the image stability over a long period of continuous use. Further, a developing memory can be generated easily. When the saponification value of the wax is less than 30, the presence of unsaponifiable matter and hydrocarbon is increased, resulting in filming of the toner on a photoconductive member or low chargeability. That is, filming is increased and chargeability of the toner is reduced over continuous use. When the saponification value is more than 300, the dispersibility of the wax with the resin is decreased in mixing and aggregation. Thus, the repulsion caused by the charging action of the toner is not likely to be relieved. Moreover, fog or toner scattering may be increased.

The wax preferably has a heating loss of not more than 8 wt % at 220° C. When the heating loss is more than 8 wt %, the glass transition point of the toner becomes low, and the storage stability is degraded. Therefore, such wax adversely affects the development property and allows fog or filming of the toner on a photoconductive member to occur. The particle size distribution in producing emulsified and dispersed particles becomes broader.

In the molecular weight characteristics of the wax based on gel permeation chromatography (GPC), it is preferable that the number-average molecular weight is 100 to 5000, the weight-average molecular weight is 200 to 10000, the ratio (weight-average molecular weight/number-average molecular weight) of the weight-average molecular weight to the number-average molecular weight is 1.01 to 8, the ratio (Z-average molecular weight/number-average molecular weight) of the Z-average molecular weight to the number-average molecular weight is 1.02 to 10, and there is at least one molecular weight maximum peak in the range of $5\times10^2$ to $1\times10^4$. It is more preferable that the number-average molecular weight is 500 to 4500, the weight-average molecular weight is 600 to 9000, the weight-average molecular weight/number-average molecular weight ratio is 1.01 to 7, and the Z-average molecular weight/number-average molecular weight ratio is 1.02 to 9. It is further preferable that the number-average molecular weight is 700 to 4000, the weight-average molecular weight is 800 to 8000, the weight-average molecular weight/number-average molecular weight ratio is 1.01 to 6, and the Z-average molecular weight/number-average molecular weight ratio is 1.02 to 8.

When the number-average molecular weight is less than 100, the weight-average molecular weight is less than 200, and the molecular weight maximum peak is in the range smaller than $5\times10^2$, the storage stability is degraded. Moreover, the handling property of the toner in a developing unit is reduced and impairs the stability of the toner concentration in two-component development. The filming of the toner on a photoconductive member may occur. The particle size distribution in producing emulsified and dispersed particles becomes broader.

When the number-average molecular weight is more than 5000, the weight-average molecular weight is more than 10000, the weight-average molecular weight/number-average molecular weight ratio is more than 8, the Z-average molecular weight/number-average molecular weight ratio is more than 10, and the molecular weight maximum peak is in the range larger than $1\times10^4$, the offset resistance is degraded. Moreover, it is difficult to reduce the particle size of the emulsified and dispersed particles of the wax. The mixing and dispersing state cannot be produced easily.

An endothermic peak temperature (melting point: Tmw) based on a DSC method is preferably 50° C. to 100° C., more preferably 55° C. to 95° C., and further preferably 65° C. to 85° C. When the endothermic peak temperature is lower than 50° C., the storage stability of the toner is degraded. When the endothermic peak temperature is higher than 100° C., it is difficult to reduce the particle size of the emulsified and dispersed particles of the wax. The mixing and dispersing state cannot be produced easily.

A preferred material for the wax may have a rate of volume increase of 2 to 30% when the temperature changes by 10° C. above the melting point. The wax expands rapidly upon changing from solid to liquid, so that when it is melted by heat during fixing, the toner particles adhere to each other more strongly. This further can improve the fixability, the releasing property for the fixing roller, and the offset resistance.

The amount of wax added is preferably 2 to 90 parts by weight, more preferably 5 to 80 parts by weight, further preferably 10 to 50 parts by weight, and most preferably 15 to 20 parts by weight per 100 parts by weight of the binder resin. When it is less than 2 parts by weight, the effect of improving the fixability cannot be obtained. When it is more than 90 parts by weight, the storage stability is a problem.

Materials for the wax may be, e.g., meadowfoam oil, jojoba oil, Japan wax, beeswax, ozocerite, carnauba wax, candelilla wax, ceresin wax, rice wax, and derivatives thereof. They can be used individually or in combinations of two or more. In particular, at least one selected from carnauba wax with a melting point of 76° C. to 90° C., candelilla wax with a melting point of 66° C. to 80° C., hydrogenated jojoba oil with a melting point of 64° C. to 78° C., hydrogenated meadowfoam oil with a melting point of 64° C. to 78° C., and rice wax with a melting point of 74° C. to 90° C. based on the DSC method also can be used preferably.

The saponification value is the milligrams of potassium hydroxide (KOH) required to saponify a 1 g sample and corresponds to the sum of an acid value and an ester value. When the saponification value is measured, a sample is saponified with approximately 0.5N potassium hydroxide in an alcohol solution, and then excess potassium hydroxide is titrated with 0.5N hydrochloric acid.

The iodine value may be determined in the following manner. The amount of halogen absorbed by a sample is measured while the halogen acts on the sample. Then, the amount of halogen absorbed is converted to iodine and expressed in grams per 100 g of the sample. The iodine value is grams of iodine absorbed by 100 g fat, and the degree of unsaturation of fatty acid in the sample increases with the iodine value. A chloroform or carbon tetrachloride solution is prepared as a sample, and an alcohol solution of iodine and mercuric chloride or a glacial acetic acid solution of iodine chloride is added to the sample. After the sample is allowed to stand, the iodine that remains without causing any reaction is titrated with a sodium thiosulfate standard solution, thus calculating the amount of iodine absorbed.

The heating loss may be measured in the following manner. A sample cell is weighed precisely to the first decimal place (W1 mg). Then, 10 to 15 mg of sample is placed in the sample cell and weighed precisely to the first decimal place (W2 mg). This sample cell is set in a differential thermal balance and measured with a weighing sensitivity of 5 mg. After measurement, the weight loss (W3 mg) of the sample at 220° C. is read to the first decimal place using a chart. The measuring device is, e.g., TGD-3000 (manufactured by ULVAC-RICO, Inc.), the rate of temperature rise is 10° C./min, the maximum temperature is 220° C., and the retention time is 1 min. Accordingly, the heating loss (%) can be determined by $W3/(W2-W1)\times100$.

The wax also may be obtained by the reaction of long chain alkyl alcohol having a carbon number of 4 to 30, unsaturated polycarboxylic acid or its anhydride, and unsaturated hydrocarbon wax. Moreover, the wax may be obtained by the reaction of long chain alkylamine, unsaturated polycarboxylic acid or its anhydride, and unsaturated hydrocarbon wax. Alternatively, the wax may be obtained by the reaction of long chain fluoroalkyl alcohol, unsaturated polycarboxylic acid or its anhydride, and unsaturated hydrocarbon wax.

For the molecular weight distribution of this wax based on GPC, it is preferable that the weight-average molecular weight is 1000 to 6000, the Z-average molecular weight is 1500 to 9000, the ratio (weight-average molecular weight/number-average molecular weight) of the weight-average molecular weight to the number-average molecular weight is 1.1 to 3.8, the ratio (Z-average molecular weight/number-average molecular weight) of the Z-average molecular weight to the number-average molecular weight is 1.5 to 6.5, there is at least one molecular weight maximum peak in the range of $1\times10^3$ to $3\times10^4$, the acid value is 1 to 80 mgKOH/g, the melting point is 50° C. to 120° C., and the penetration number is not more than 4 at 25° C.

It is more preferable that the weight-average molecular weight is 1000 to 5000, the Z-average molecular weight is 1700 to 8000, the weight-average molecular weight/number-average molecular weight ratio is 1.1 to 2.8, the Z-average molecular weight/number-average molecular weight ratio is 1.5 to 4.5, there is at least one molecular weight maximum peak in the range of $1\times10^3$ to $1\times10^4$, the acid value is 10 to 70 mgKOH/g, and the melting point is 60° C. to 110° C. It is further preferable that the weight-average molecular weight is 1000 to 2500, the Z-average molecular weight is 1900 to 3000, the weight-average molecular weight/number-average molecular weight ratio is 1.2 to 1.8, the Z-average molecular weight/number-average molecular weight ratio is 1.7 to 2.5, there is at least one molecular weight maximum peak in the range of $1\times10^3$ to $3\times10^3$, the acid value is 35 to 50 mgKOH/g, and the melting point is 65° C. to 95° C.

The wax with the above molecular weight distributions can contribute to higher offset resistance, glossiness, and OHP transmittance in the oilless fixing. Moreover, the wax does not decrease the storage stability at high temperatures. When an image is formed by arranging three layers of color toner on a thin paper, the wax is particularly effective for improving the separability of the paper from the fixing roller or belt.

The wax can be mixed and aggregated uniformly with the resin particles and the pigment particles. This can eliminate the suspended solids, thereby suppressing a dull color. When a resin further is fused with the particles, the liberation of the wax is not likely to occur, and the mixing and dispersing state can be produced easily.

Even if a fluorine or silicone material is used for the fixing roller, offset of a halftone image can be suppressed.

By combining the toner to which the wax is added with a carrier (which will be described later), it is possible not only to achieve the oilless fixing but also to suppress the occurrence of spent on the carrier. Accordingly, the life of a developer can be made longer. While the uniformity of the toner in a developing unit can be maintained, the generation of a developing memory also can be reduced. Further, the charge stability can be achieved over continuous use, which ensures compatibility between the fixability and the development stability.

When the carbon number of the long chain alkyl group of the wax is less than 4, the releasing action is weakened, so that the separability and the high-temperature offset resistance are degraded. When the carbon number is more than 30, the mixing and aggregation of the wax with the resin become poor, resulting in low dispersibility. When the acid value is less than 1 mgKOH/g, the amount of charge of the toner is reduced over a long period of use. When the acid value is more than 80 mgKOH/g, the moisture resistance is decreased to increase fog under high humidity. Moreover, it is difficult to reduce the particle size of the emulsified and dispersed particles of the wax. The mixing and dispersing state cannot be produced easily.

When the melting point is less than 50° C., the storage stability of the toner is degraded. When it is more than 120° C., the releasing action is weakened, and the temperature range of offset resistance is narrowed. Moreover, it is difficult to reduce the particle size of the emulsified and dispersed particles of the wax.

When the penetration number is more than 4 at 25° C., the toughness is reduced to cause filming of the toner on a photoconductive member over a long period of use.

When the weight-average molecular weight is less than 1000, the Z-average molecular weight is less than 1500, the weight-average molecular weight/number-average molecular weight ratio is less than 1.1, the Z-average molecular weight/number-average molecular weight ratio is less than 1.5, and the molecular weight maximum peak is in the range smaller than $1\times10^3$, the storage stability of the toner is degraded, thus causing filming of the toner on a photoconductive member or intermediate transfer member. The handling property of the toner in a developing unit is reduced and impairs the stability of the toner concentration in two-component development. Further, a developing memory can be generated easily. When emulsified and dispersed particles are produced under the strong shearing force of a high-speed rotating body, the particle size distribution becomes broader.

When the weight-average molecular weight is more than 6000, the Z-average molecular weight is more than 9000, the weight-average molecular weight/number-average molecular weight ratio is more than 3.8, the Z-average molecular weight/number-average molecular weight ratio is more than 6.5, and the molecular weight maximum peak is in the range larger than $3\times10^4$, the releasing action is weakened, and the offset resistance during fixing is degraded. Moreover, it is difficult to reduce the particle size of the emulsified and dispersed particles of the wax. The mixing and dispersing state cannot be produced easily.

Examples of the alcohol include alcohols having a long alkyl chain such as octanol, dodecanol, stearyl alcohol, nonacosanol, and pentadecanol. Examples of the amines include N-methylhexylamine, nonylamine, stearylamine, and nonadecylamine. Examples of the fluoroalkyl alcohol include 1-methoxy-(perfluoro-2-methyl-1-propene), and 3-perfluorooctyl-1,2-epoxypropane. Examples of the unsaturated polycarboxylic acid or its anhydride include maleic acid, maleic anhydride, itaconic acid, itaconic anhydride, citraconic acid, and citraconic anhydride. They can be used individually or in combinations of two or more. In particular, the maleic acid and the maleic anhydride are preferred. Examples of the unsaturated hydrocarbon wax include ethylene, propylene, and α-olefin.

The unsaturated polycarboxylic acid or its anhydride is polymerized using alcohol or amine, and then is added to the synthetic hydrocarbon wax in the presence of dicumyl peroxide or tert-butylperoxy isopropyl monocarbonate.

The amount of wax added is preferably 2 to 90 parts by weight, more preferably 5 to 50 parts by weight, further preferably 10 to 30 parts by weight, and most preferably 15 to 20 parts by weight per 100 parts by weight of the binder resin. When it is less than 2 parts by weight, the effect of improving the fixability cannot be obtained. When it is more than 90 parts by weight, the storage stability is a problem.

Preferred materials as the wax added to the toner of this embodiment may be, e.g., a derivative of hydroxystearic acid or polyol fatty acid ester such as glycerin fatty acid ester, glycol fatty acid ester, or sorbitan fatty acid ester. They can be used individually or in combinations of two or more. It is possible not only to achieve the oilless fixing but also to increase the life of a developer. While the uniformity of the toner in a developing unit can be maintained, the generation of a developing memory also can be reduced.

Examples of the derivative of hydroxystearic acid include methyl 12-hydroxystearate, butyl 12-hydroxystearate, propylene glycol mono 12-hydroxystearate, glycerin mono 12-hydroxystearate, and ethylene glycol mono 12-hydroxystearate. These materials have the effects of preventing filming and winding of a paper in the oilless fixing.

Examples of the glycerin fatty acid ester include glycerol monostearate, glycerol tristearate, glycerol stearate, glycerol monopalmitate, and glycerol tripalmitate. These materials have the effects of relieving cold offset at low temperatures in the oilless fixing and preventing a reduction in the transfer property.

Examples of the glycol fatty acid ester include propylene glycol fatty acid ester such as propylene glycol monopalmitate or propylene glycol monostearate and ethylene glycol fatty acid ester such as ethylene glycol monostearate or ethylene glycol monopalmitate. These materials have the effects of improving the oilless fixability and preventing spent on a carrier while increasing the sliding property in development.

Examples of the sorbitan fatty acid ester include sorbitan monopalmitate, sorbitan monostearate, sorbitan tripalmitate, and sorbitan tristearate. Moreover, stearic acid ester of pentaerythritol, mixed esters of adipic acid and stearic acid or oleic acid, and the like are preferred. They can be used individually or in combinations of two or more. These materials have the effects of preventing filming and winding of a paper in the oilless fixing.

Moreover, low molecular-weight polyolefin such as polyethylene, polypropylene, or polybutene, paraffin wax, microcrystalline wax, or Fischer-Tropsch wax also can be used.

When two or more types of waxes with different melting points are used together, the first particles and the second particles can be formed as a result of a difference in melting point between the waxes and the mixing ratio.

For example, wax having a higher melting point such as polyethylene, polypropylene, paraffin wax, microcrystalline wax, or Fischer-Tropsch wax may be mixed with wax having a lower melting point than these waxes such as a derivative of hydroxystearic acid or polyol fatty acid ester including, e.g., glycerin fatty acid ester, glycol fatty acid ester, and sorbitan fatty acid ester. When the mixing ratio of polyethylene, polypropylene, paraffin wax, microcrystalline wax, or Fischer-Tropsch wax is 50 wt % or more, the second particles formed of the resin and the wax in the mixed and dispersed state can be increased and present in proportion of at least 50% by number.

The wax such as polyethylene, polypropylene, paraffin wax, microcrystalline wax, or Fischer-Tropsch wax also may be mixed with wax having an iodine value of not more than 25, a saponification value of 30 to 300, and a lower melting point than these waxes. When the mixing ratio of polyethylene, polypropylene, paraffin wax, microcrystalline wax, or Fischer-Tropsch wax is 50 wt % or more, the second particles formed of the resin and the wax in the mixed and dispersed state can be increased and present in proportion of at least 50% by number.

Moreover, the wax such as a derivative of hydroxystearic acid or polyol fatty acid ester including, e.g., glycerin fatty acid ester, glycol fatty acid ester, and sorbitan fatty acid ester may be mixed with wax having an iodine value of not more than 25, a saponification value of 30 to 300, and a lower melting point than these waxes. When the mixing ratio of a derivative of hydroxystearic acid or polyol fatty acid ester including, e.g., glycerin fatty acid ester, glycol fatty acid ester, and sorbitan fatty acid ester is 50 wt % or more, the second particles formed of the resin and the wax in the mixed and dispersed state can be increased and present in proportion of at least 50% by number.

Alternatively, wax having an iodine value of not more than 25 and a saponification value of 30 to 300 may be mixed with wax obtained by the reaction of long chain alkyl alcohol having a carbon number of 4 to 30, unsaturated polycarboxylic acid or its anhydride, and unsaturated hydrocarbon wax. Similarly, when the mixing ratio of the wax including the unsaturated hydrocarbon wax is 50 wt % or more, the second particles formed of the resin and the wax in the mixed and dispersed state can be increased and present in proportion of at least 50% by number.

This can be attributed to the effects of a difference in melting point and a difference in molecular composition between the resin and the wax.

(3) Resin

As the resin particles of the toner of this embodiment, e.g., a thermoplastic binder resin can be used. Specific examples of the thermoplastic binder resin include the following: styrenes such as styrene, parachloro styrene, and α-methyl styrene; acrylic monomers such as methyl acrylate, ethyl acrylate, n-propyl acrylate, lauryl acrylate, and 2-ethylhexyl acrylate; methacrylic monomers such as methyl methacrylate, ethyl methacrylate, n-propyl methacrylate, lauryl methacrylate, and 2-ethylhexyl methacrylate; ethylene-unsaturated acid monomers such as acrylic acid, methacrylic acid, and sodium styrenesulfonate; vinyl nitriles such as acrylonitrile and methacrylonitrile; vinyl ethers such as vinyl methylether and vinyl isobutylether; vinyl ketones such as vinyl methylketone, vinyl ethylketone, and vinyl isopropenylketone; and olefins such as ethylene, propylene, and butadiene, and a homopolymer, a copolymer, or a mixture of these substances (monomers). The specific examples further may include a non-vinyl condensed resin such as an epoxy resin, a polyester resin, a polyurethane resin, a polyamide resin, a cellulose resin, or a polyether resin, a mixture of the non-vinyl condensed resin and any of the vinyl resins as described above, and a graft copolymer formed by polymerization of vinyl monomers in the presence of the non-vinyl condensed resin.

Among these resins, the vinyl resin is preferred particularly. The vinyl resin is advantageous in that a resin particle dispersion can be prepared easily, e.g., by emulsion polymerization or seed polymerization using an ionic surface-active agent. Examples of the vinyl monomer include a monomer to be used as a material for a vinyl polymer acid or a vinyl polymer base, such as acrylic acid, methacrylic acid, maleic acid, cinnamic acid, fumaric acid, vinyl sulfonic acid, ethylene imine, vinyl pyridine, or vinyl amine. In the present invention, the resin particles preferably contain the vinyl monomer as a monomer component. In the present invention, the vinyl polymer acid is more preferred among the vinyl monomers in view of ease of the vinyl resin formation reaction. Specifically, a dissociating vinyl monomer having a carboxyl group as a dissociation group such as acrylic acid, methacrylic acid, maleic acid, cinnamic acid, or fumaric acid is preferred particularly in terms of controlling the polymerization degree or the glass transition point.

The content of resin particles in the resin particle dispersion is generally 5 to 50 wt %, and preferably 10 to 30 wt %. The molecular weights of the resin, wax, and toner can be measured by gel permeation chromatography (GPC) using several types of monodisperse polystyrene as standard samples.

The measurement may be performed with HPLC 8120 series manufactured by TOSOH CORP., using TSK gel super HM-H H4000/H3000/H2000 (7.8 mm diameter, 150 mm×3) as a column and THF (tetrahydrofuran) as an eluent, at a flow rate of 0.6 ml/min, a sample concentration of 0.1%, an injection amount of 20 μL, RI as a detector, and at a temperature of 40° C. Prior to the measurement, the sample is dissolved in THF, and then is filtered through a 0.45 μm filter so that additives such as silica are removed to measure the resin component. The measurement requirement is that the molecular weight distribution of the subject sample is in the range where the logarithms and the count numbers of the molecular weights in the analytical curve obtained from the several types of monodisperse polystyrene standard samples form a straight line.

The wax obtained by the reaction of long chain alkyl alcohol having a carbon number of 4 to 30, unsaturated polycarboxylic acid or its anhydride, and unsaturated hydrocarbon wax can be measured with GPC-150C (manufactured by Waters Corporation), using Shodex HT-806M (8.0 mm I.D. −30 cm×2) as a column and o-dichlorobenzene as an eluent, at a flow rate of 1.0 mL/min, a sample concentration of 0.3%, an injection amount of 200 μL, RI as a detector, and at a temperature of 130° C. Prior to the measurement, the sample is dissolved in a solvent, and then is filtered through a 0.5 μm sintered metal filter. The measurement requirement is that the molecular weight distribution of the subject sample is in the range where the logarithms and the count numbers of the molecular weights in the analytical curve obtained from the several types of monodisperse polystyrene standard samples form a straight line.

The softening point of the binder resin can be measured with a capillary rheometer flow tester (CFT-500, constant-pressure extrusion system, manufactured by Shimadzu Corporation). A load of about $9.8\times10^5$ N/m$^2$ is applied to a 1 cm$^3$ sample with a plunger while heating the sample at a temperature increase rate of 6° C./min, so that the sample is extruded from a die having a diameter of 1 mm and a length of 1 mm. Based on the relationship between the piston stroke of the plunger and the temperature increase characteristics, when the temperature at which the piston stroke starts to rise is a flow start temperature (Tfb), one-half the difference between the minimum value of a curve and the flow end point is determined. Then, the resultant value and the minimum value of the curve are added to define a point, and the temperature of this point is identified as a melting point (softening point Tm) according to a ½ method.

The glass transition point of the resin can be measured with a differential scanning calorimeter (DSC-50 manufactured by Shimadzu Corporation). The temperature of a sample is raised to 100° C., retained for 3 minutes, and reduced to room temperature at 10° C./min. Subsequently, the temperature is raised at 10° C./min, and a thermal history of the sample is measured. In the thermal history, an intersection point of an extension line of the base line lower than a glass transition point and a tangent that shows the maximum inclination between the rising point and the highest point of a peak is determined. The temperature of this intersection point is identified as a glass transition point.

The melting point at an endothermic peak of the wax based on the DSC method can be measured with a differential scanning calorimeter (DSC-50 manufactured by Shimadzu Corporation). The temperature of a sample is raised to 200° C. at 5° C./min, retained for 5 minutes, and reduced to 10° C. rapidly. Subsequently, the sample is allowed to stand for 15 minutes, and the temperature is raised at 5° C./min. Then, the melting point is determined from the endothermic (melt) peak. The amount of the sample placed in a cell is 10 mg±2 mg.

(4) Charge Control Agent

The charge control agent may be an acrylic/sulfonic acid polymer, and preferably a vinyl copolymer of a styrene monomer and an acrylic acid monomer having a sulfonic group as a polar group. In particular, an acrylamide-2-methylpropane sulfonic acid copolymer can provide favorable characteristics. By combining the toner to which the charge control agent is added with a carrier (which will be described later), the handling property of the toner in a developing unit can be improved, thus increasing the uniformity of the toner concentration. The generation of a developing memory also can be reduced. Preferred materials for the charge control agent may include a metal salt of a salicylic acid derivative.

This configuration can suppress the disturbance of an image caused by the charging action during fixing. Such a feature is attributed to the effect of the charge polarity of the functional group having an acid value of the wax and the metal salt. Moreover, it is possible to prevent a decrease in charge amount over continuous use.

The charge control agent may be melted with resin monomers (e.g., styrene monomers are appropriate) in emulsion polymerization. Therefore, when the monomers are polymerized, a resin particle dispersion including the charge control agent can be produced.

The amount of charge control agent added is preferably 0.1 to 5 parts by weight, more preferably 0.1 to 2 parts by weight, and further preferably 0.5 to 1.5 parts by weight per 100 parts by weight of the resin. When it is less than 0.1 parts by weight, the effect of the charging action is lost. When it is more than 5 parts by weight, the dispersion cannot be uniform, and color images are prone to have a dull color.

(5) Pigment

The colorant used in this embodiment may include, e.g., carbon black, iron black, graphite, nigrosine, a metal complex of azo dyes, acetoacetic acid aryl amide monoazo yellow pigments such as C. I. Pigment Yellow 1, 3, 74, 97, and 98, acetoacetic acid aryl amide disazo yellow pigments such as C. I. Pigment Yellow 12, 13, 14, and 17, C. I. Solvent Yellow 19, 77, and 79, or C. I. Disperse Yellow 164. In particular, benzimidazolone pigments of C. I. Pigment Yellow 93, 180, and 185 are suitable.

At least one selected from red pigments such as C. I. Pigment Red 48, 49:1, 53:1, 57, 57:1, 81, 122 and 5, red dyes such as C. I. Solvent Red 49, 52, 58 and 8, and blue dyes/pigments of phthalocyanine and its derivative such as C. I. Pigment Blue 15:3 may be added. The added amount is preferably 3 to 8 parts by weight per 100 parts by weight of the binder resin.

The median diameter of the pigment particles is generally not more than 1 μm, and preferably 0.01 to 1 μm. When the median diameter is more than 1 μm, toner as a final product for electrostatic charge image development can have a broader particle size distribution. Moreover, liberated particles are generated and tend to reduce the performance or reliability. When the median diameter is within the above range, these disadvantages are eliminated, and the uneven distribution of the toner is decreased. Therefore, the dispersion of the pigment particles in the toner can be improved, resulting in a smaller variation in performance and reliability. The median diameter can be measured, e.g., by a laser diffraction particle size analyzer (LA 920 manufactured by Horiba, Ltd.).

(6) Additive

In this embodiment, the additive may be, e.g., metal oxide fine powder such as silica, alumina, titanium oxide, zirconia, magnesia, ferrite, and magnetite, titanate such as barium titanate, calcium titanate, and strontium titanate, zirconate such as barium zirconate, calcium zirconate, and strontium zirconate, or a mixture of these substances. The additive can be made hydrophobic as needed.

A preferred silicone oil material that is used to treat silica is expressed by Chemical Formula (1).

Chemical Formula (1):

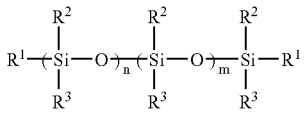

(where $R^2$ is alkyl having a carbon number of 1 to 3, $R^3$ is alkyl, halogen-modified alkyl or phenyl, or $R^1$ is an alkyl group or alkoxy group having a carbon number of 1 to 3, and m and n are integers of 1 to 100).

Examples of the silicone oil material include dimethyl silicone oil, methyl hydrogen silicone oil, methyl phenyl silicone oil, cyclic dimethyl silicone oil, epoxy modified silicone oil, carboxyl modified silicone oil, carbinol modified silicone oil, methacrylic modified silicone oil, mercapto modified silicone oil, polyether modified silicone oil, methyl styryl modified silicone oil, alkyl modified silicone oil, fluorine modified silicone oil, amino modified silicone oil, and chlorophenyl modified silicone oil. The silica that is treated with at least one of the above silicone oil materials is used preferably. For example, SH200, SH510, SF230, SH203, BY16-823, or BY16-855B manufactured by Toray-Dow Corning Co., Ltd can be used. The treatment may be performed by mixing inorganic fine powder and the silicone oil material with a mixer (e.g., a Henshel mixer). Moreover, the silicone oil material may be sprayed onto silica. Alternatively, the silicone oil material may be dissolved or dispersed in a solvent, and mixed with silica fine powder, followed by removal of the solvent. The amount of silicone oil material is preferably 1 to 20 parts by weight per 100 parts by weight of the inorganic fine powder.

Examples of a silane coupling agent include dimethyldichlorosilane, trimethylchlorosilane, allyldimethylchlorosilane, hexamethyldisilazane, allylphenyldichlorosilane, benzyl methyl chlorosilane, vinyltriethoxysilane, γ-methacryloxypropyltrimethoxysilane, vinyltriacetoxysilane, divinylchlorosilane, and dimethylvinylchlorosilane. The silane coupling agent may be treated with a dry treatment in which the fine powder is fluidized by agitation or the like, and an evaporated silane coupling agent is reacted with the fluidized powder, or a wet treatment in which a silane coupling agent dispersed in a solvent is added dropwise to the fine powder.

It is also preferable that the silicone oil material is treated after a silane coupling treatment.

The inorganic fine powder having positive chargeability may be treated with aminosilane, amino modified silicone oil expressed by Chemical Formula (2), or epoxy modified silicone oil.

Chemical Formula (2):

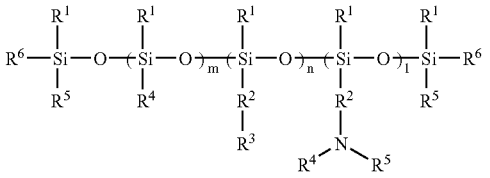

(where $R^1$ and $R^6$ are hydrogen, an alkyl group, an aryl group, or an alkoxy group, $R^2$ is an alkylene group or a phenylene group, R3 is a compound with a structure containing a nitrogen heterocyclic ring, $R^4$ and $R^5$ are hydrogen, an alkyl group, or an aryl group, m is positive numbers of not less than 1, and n and 1 are positive integers including 0).

To enhance a hydrophobic treatment, hexamethyldisilazane, dimethyldichlorosilane, or other silicone oil also can be used along with the above materials. For example, at least one selected from dimethyl silicone oil, methylphenyl silicone oil, and alkyl modified silicone oil is preferred to treat the inorganic fine powder.

Fatty acid ester, fatty acid amide, and a fatty acid metal salt also can be used to treat the surface of the inorganic fine powder, and silica or titanium oxide fine powder whose surface is treated with at least one of these materials is more preferred.

Examples of the fatty acid and the fatty acid metal salt include caprylic acid, capric acid, undecylic acid, lauric acid, myristic acid, palmitic acid, stearic acid, behenic acid, montanic acid, lacceric acid, oleic acid, erucic acid, sorbic acid, and linoleic acid. In particular, fatty acid having a carbon number of 14 to 20 is preferred.

Metals of the fatty acid metal salt may be, e.g., aluminum, zinc, calcium, magnesium, lithium, sodium, lead, or barium. Among these metals, aluminum, zinc, and sodium are preferred. Further, mono- and di-fatty acid aluminum such as aluminum distearate ($Al(OH)(C_{17}H_{35}COO)_2$) or aluminum monostearate ($Al(OH)_2(C_{17}H_{35}COO)$) are particularly preferred. By containing a hydroxy group, they can prevent overcharge and suppress a transfer failure. Moreover, it is possible to improve the treatment of the inorganic fine powder such as silica.

The handling property of toner with a small particle size can be improved, and therefore high image quality and high transfer performance can be achieved in the development and transfer processes. Thus, an electrostatic latent image can be developed more faithfully and transferred without reducing a transfer ratio of the toner particles. In the case of tandem transfer, it is also possible to prevent retransfer and to suppress transfer voids. Moreover, high image density can be achieved even with a small amount of development. By combining the toner to which the additive is added with a carrier (which will be described later), higher resistance to spent can be obtained, and the handling property of the toner in a developing unit can be improved, thus increasing the uniformity of the toner concentration. The generation of a developing memory also can be reduced.

It is preferable that 1.0 to 6 parts by weight of inorganic fine powder having an average particle size of 6 nm to 200 nm are added to 100 parts by weight of toner base particles. When the average particle size is less than 6 nm, suspended silica particles are generated, and filming of the toner on a photoconductive member is likely to occur. Therefore, it is difficult to avoid the occurrence of reverse transfer. When the average particle size is more than 200 nm, the flowability of the toner is decreased. When the amount of inorganic fine powder added is less than 1.0 part by weight, the flowability of the toner is decreased, and it is difficult to avoid the occurrence of reverse transfer. When it is more than 6 parts by weight, suspended silica particles are generated, and filming of the toner on a photoconductive member is likely to occur, thus degrading the high-temperature offset resistance.

Moreover, it is preferable that 0.5 to 2.5 parts by weight of inorganic fine powder having an average particle size of 6 nm to 20 nm, and 0.5 to 3.5 parts by weight of inorganic fine powder having an average particle size of 20 nm to 200 nm are added to 100 parts by weight of toner base particles. With this configuration, silica can have different functions to ensure larger margins against the handling property of the toner in development, reverse transfer, transfer voids, and scattering during transfer. It is also possible to prevent spent on a carrier.

In this case, the ignition loss of the inorganic fine powder having an average particle size of 6 nm to 20 nm is preferably 1.5 to 25 wt %, and the ignition loss of the inorganic fine powder having an average particle size of 20 nm to 200 nm is preferably 0.5 to 23 wt %.

By specifying the ignition loss of silica, larger margins can be ensured against reverse transfer, transfer voids, and scattering during transfer. When the silica is combined with the carrier or the toner to which the wax is added, higher resistance to spent can be obtained, and the handling property of the toner in a developing unit can be improved, thus increasing the stability of the toner concentration in two-component development. The generation of a developing memory also can be reduced.

When the ignition loss of the inorganic fine powder having an average particle size of 6 nm to 20 nm is less than 1.5 wt %, the margins against reverse transfer and transfer voids become narrow. When the ignition loss is more than 25 wt %, the surface treatment is not uniform, resulting in charge variations. The ignition loss is preferably 1.5 to 20 wt %, and more preferably 5 to 19 wt %.

When the ignition loss of the inorganic fine powder having an average particle size of 20 nm to 200 nm is less than 0.5 wt %, the margins against reverse transfer and transfer voids become narrow. When the ignition loss is more than 23 wt %, the surface treatment is not uniform, resulting in charge variations. The ignition loss is preferably 1.5 to 18 wt %, and more preferably 5 to 16 wt %.

It is also preferable that 0.5 to 1.5 parts by weight of positively charged inorganic fine powder having an average particle size of 6 nm to 200 nm and an ignition loss of 0.5 to 25 wt % are added further to 100 parts by weight of toner base particles.

The addition of the positively charged inorganic fine powder can suppress the overcharge of the toner for a long period of continuous use and increase the life of a developer. Therefore, the scattering of the toner during transfer caused by overcharge also can be reduced. Moreover, it is possible to prevent spent on a carrier. When the amount of positively charged inorganic fine powder added is less than 0.5 parts by weight, these effects are not likely to be obtained. When it is more than 1.5 parts by weight, fog is increased significantly during development. The ignition loss is preferably 1.5 to 20 wt %, and more preferably 5 to 19 wt %.

A drying loss (%) can be determined in the following manner. A container is dried, allowed to stand and cool, and weighed precisely beforehand. Then, a sample (about 1 g) is put in the container, weighed precisely, and dried for 2 hours with a hot-air dryer at 105° C.±1° C. After cooling for 30 minutes in a desiccator, the weight is measured, and the drying loss is calculated by the following formula.

$$\text{Drying loss (\%)} = \text{weight loss (g) by drying/sample amount (g)} \times 100$$

An ignition loss can be determined in the following manner. A magnetic crucible is dried, allowed to stand and cool, and weighed precisely beforehand. Then, a sample (about 1 g) is put in the crucible, weighed precisely, and ignited for 2 hours in an electric furnace at 500° C. After cooling for 1 hour in a desiccator, the weight is measured, and the ignition loss is calculated by the following formula.

$$\text{Ignition loss (\%)} = \text{weight loss (g) by ignition/sample amount (g)} \times 100$$

The amount of moisture absorption of the surface-treated inorganic fine powder may be not more than 1 wt %, preferably not more than 0.5 wt %, more preferably not more than 0.1 wt %, and further preferably not more than 0.05 wt %. When it is more than 1 wt %, the chargeability is degraded, and filming of the toner on a photoconductive member occurs. The amount of moisture absorption can be measured by using a continuous vapor absorption measuring device (BELSORP 18 manufactured by BEL JAPAN, INC.).

The degree of hydrophobicity can be determined in the following manner. A sample (0.2 g) is weighed in a 250 ml beaker containing 50 ml of distilled water. Then, methanol is added from a buret, whose end is put into the water, until the whole inorganic fine powder is wet while continuing the stirring slowly with a magnetic stirrer. Based on the amount a (ml) of methanol required to wet the inorganic fine powder completely, the degree of hydrophobicity is calculated by the following formula.

$$\text{Degree of hydrophobicity (\%)} = (a/(50+a)) \times 100$$

(7) Powder Physical Characteristics of Toner

In this embodiment, the volume-average particle size of toner base particles including a binder resin, a colorant, and wax is 3 to 7 μm, preferably 3 to 6.5 μm, and more preferably 3 to 4.5 μm. The particle size distribution is such that the content of the toner base particles having a particle size of 2.52 to 4 μm in a number distribution is 5 to 65% by number, and the toner base particles having a particle size of 6.35 to 10.1 μm in a volume distribution is 5 to 35% by volume. The coefficient of variation in the volume-average particle size is not more than 25.

Preferably, the particle size distribution is such that the content of the toner base particles having a particle size of 2.52 to 4 μm in the number distribution is 15 to 65% by number, and the toner base particles having a particle size of 6.35 to 10.1 μm in the volume distribution is 5 to 25% by volume. The coefficient of variation in the volume-average particle size is not more than 20.

More preferably, the particle size distribution is such that the content of the toner base particles having a particle size of 2.52 to 4 μm in the number distribution is 25 to 65% by number, and the toner base particles having a particle size of 6.35 to 10.1 μm in the volume distribution is 5 to 15% by volume. The coefficient of variation in the volume-average particle size is not more than 18.

The toner base particles with the above characteristics can provide high-resolution image quality, prevent reverse transfer and transfer voids during tandem transfer, and achieve the oilless fixing.

When the volume-average particle size is more than 7 μm, the image quality and the transfer property cannot be ensured together. When the volume-average particle size is less than 3 μm, the handling property of the toner particles in development is reduced. When the content of the toner base particles having a particle size of 2.52 to 4 μm in the number distribution is less than 5% by number, the image quality and the transfer property cannot be ensured together. When it is more than 65% by number, the handling property of the toner particles in development is reduced. When the toner base particles having a particle size of 6.35 to 10.1 μm in the volume distribution is more than 35% by volume, the image quality and the transfer property cannot be ensured together. When it is less than 5% by volume, the toner productivity is reduced and the cost is increased.

The coefficient of variation of the volume particle size distribution of the toner base particles is preferably 10 to 25%, more preferably 10 to 20%, and further preferably 10 to 15%. The coefficient of variation of the number particle size distribution of the toner base particles is preferably 10 to 28%, more preferably 10 to 23%, and further preferably 10 to 18%.

The coefficient of variation is obtained by dividing a standard deviation by an average particle size of the toner particles based on the measurement using a Coulter Counter (manufactured by Coulter Electronics, Inc.). When the particle sizes of n particles are measured, the standard deviation can be expressed by the square root of the value that is obtained by dividing the square of a difference between each of the n measured values and the mean value by (n−1).

In other words, the coefficient of variation indicates the degree of expansion of the particle size distribution. When the coefficient of variation of the volume particle size distribution or the number particle size distribution is less than 10%, the production becomes difficult, and the cost is increased. When the coefficient of variation of the volume particle size distribution is more than 25%, or when the coefficient of variation of the number particle size distribution is more than 28%, the particle size distribution is broader, and the agglomeration of toner is stronger. This may lead to filming of the toner on a photoconductive member, a transfer failure, and difficulty of recycling the residual toner in a cleanerless process.

The fine powder in the toner affects the flowability, image quality, and storage stability of the toner, filming of the toner on a photoconductive member, developing roller, or transfer member, the aging property, the transfer property, and particularly the multilayer transfer property in a tandem system. The fine powder also affects the offset resistance, glossiness, and transmittance in the oilless fixing. When the toner includes wax or the like to achieve the oilless fixing, the amount of fine powder may affect compatibility between the oilless fixing and the tandem transfer property.

If the amount of fine powder is excessively large, i.e., the content of the toner base particles having a particle size of 2.52 to 4 μm is more than 65% by number, filming of the toner on a photoconductive member, developing roller, or transfer member occurs. The adhesion of the fine powder to a heat roller is large, and thus tends to cause offset. In the tandem system, the agglomeration of the toner is likely to be stronger, which easily leads to a transfer failure of the second color during multilayer transfer. If the amount of fine powder is reduced, the image quality may be degraded. Therefore, an appropriate range is necessary.

The particle size distribution is measured, e.g., by using a Coulter Counter TA-II (manufactured by Coulter Electronics, Inc.). An interface (manufactured by Nikkaki Bios Co., Ltd.) for outputting a number distribution and a volume distribution and a personal computer are connected to the Coulter Counter TA-II. An electrolytic solution (about 50 ml) is prepared by including a surface-active agent (sodium lauryl sulfate) so as to have a concentration of 1%. About 2 mg of measuring toner is added to the electrolytic solution. This electrolytic solution in which the sample is suspended is dispersed for about 3 minutes with an ultrasonic dispersing device, and then is measured using the 70 μm aperture of the Coulter Counter TA-II. In the 70 μm aperture system, the measurement range of the particle size distribution is 1.26 μm to 50.8 μm. However, the region smaller than 2.0 μm is not suitable for practical use because the measurement accuracy or reproducibility is low under the influence of external noise or the like. Therefore, the measurement range is set from 2.0 μm to 50.8 μm.

A compression ratio calculated from a static bulk density and a dynamic bulk density can be used as an index of the flowability of the toner. The toner flowability may be affected by the particle size distribution and particle shape of the toner, the additive, and the type or amount of wax. When the particle size distribution of the toner is narrow, less fine powder is present, the toner surface is not rough, the toner shape is close to spherical, a large amount of additive is added, and the additive has a small particle size, the compression ratio is reduced, and the toner flowability is increased. The compression ratio is preferably 5 to 40%, and more preferably 10 to 30%. This can ensure compatibility between the oilless fixing and the multilayer transfer property in the tandem system. When the compression ratio is less than 5%, the fixability is degraded, and particularly the transmittance is likely to be lower. Moreover, toner scattering from the developing roller may be increased. When the compression ratio is more than 40%, the transfer property is decreased to cause a transfer failure such as transfer voids in the tandem system.

(8) Carrier

A resin-coated carrier of this embodiment preferably includes a carrier core provided with a coating of fluorine modified silicone resin containing an aminosilane coupling agent.

The carrier core may be, e.g., an iron powder carrier core, a ferrite carrier core, a magnetite carrier core, or a resin-dispersed carrier core in which a magnetic body is dispersed in the resin.

An example of the ferrite carrier core is expressed generally by the following formula.

$$(MO)_X(Fe_2O_3)_Y$$

In the formula, M includes at least one selected from Cu, Zn, Fe, Mg, Mn, Ca, Li, Ti, Ni, Sn, Sr, Al, Ba, Co, and Mo, and X and Y are a molar ratio and satisfy X+Y=100.

The ferrite carrier core includes $Fe_2O_3$ as the main material and at least one oxide of M selected from Cu, Zn, Fe, Mg, Mn, Ca, Li, Ti, Ni, Sn, Sr, Al, Ba, Co, and Mo.

The ferrite carrier core may be produced in the following manner. First, the above materials such as each oxide are blended in an appropriate amount. The blend is placed in a wet ball mill, and then is pulverized and mixed for 10 hours. The resultant mixture is dried and kept at 950° C. for 4 hours. Moreover, the mixture is pulverized for 24 hours in the wet ball mill, to which a binder (polyvinyl alcohol), an antifoaming agent, a surface-active agent, and the like are added, thus forming a slurry with a particle size of 5 μm or less. The slurry is granulated and dried. The granulated substance is kept at 1300° C. for 6 hours while controlling the oxygen concentration. Subsequently, this substance was pulverized and classified further to achieve a desired particle size distribution.

A fluorine modified silicone resin is essential for the resin coating of the present invention. The fluorine modified silicone resin may be a cross-linked fluorine modified silicone resin obtained by the reaction between an organosilicon compound containing a perfluoroalkyl group and polyorganosiloxane. It is preferable that 3 to 20 parts by weight of the organosilicon compound containing a perfluoroalkyl group is mixed with 100 parts by weight of the polyorganosiloxane.

The polyorganosiloxane preferably has at least one repeating unit selected from Chemical Formulas (3) and (4).

Chemical Formula (3):

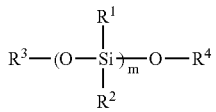

(where $R^1$ and $R^2$ are a hydrogen atom, a halogen atom, a hydroxy group, a methoxy group, an alkyl group having a carbon number of 1 to 4, or a phenyl group, $R^3$ and $R^4$ are an alkyl group having a carbon number of 1 to 4, and m represents a mean degree of polymerization and is positive integers (preferably in the range of 2 to 500, and more preferably in the range of 5 to 200)).

Chemical Formula (4):

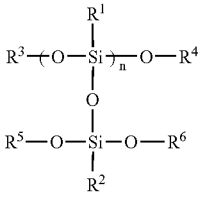

(where $R^1$ and $R^2$ are a hydrogen atom, a halogen atom, a hydroxy group, a methoxy group, an alkyl group having a carbon number of 1 to 4, or a phenyl group, $R^3$, $R^4$, $R^5$ and $R^6$ are an alkyl group having a carbon number of 1 to 4, and n represents a mean degree of polymerization and is positive integers (preferably in the range of 2 to 500, and more preferably in the range of 5 to 200)).

Examples of the organosilicon compound containing a perfluoroalkyl group include $CF_3CH_2CH_2Si(OCH_3)_3$, $C_4F_9CH_2CH_2Si(CH_3)(OCH_3)_2$, $C_8F_{17}CH_2CH_2Si(OCH_3)_3$, $C_8F_{17}CH_2CH_2Si(OC_2H_5)_3$, and $(CF)_2CF(CF_2)_8CH_2CH_2Si(OCH_3)_3$. In particular, a compound containing a trifluoropropyl group is preferred.

In this embodiment, the aminosilane coupling agent is included in the resin coating. As the aminosilane coupling agent, e.g., the following known materials can be used: γ-(2-aminoethyl)aminopropyltrimethoxysilane, γ-(2-aminoethyl) aminopropylmethyldimethoxysilane, and octadecylmethyl [3-(trimethoxysilyl)propyl]ammonium chloride (corresponding to SH6020, SZ6023, and AY43-021 manufactured by Toray-Dow Corning Co., Ltd.); KBM602, KBM603, KBE903, and KBM573 (manufactured by Shin-Etsu Chemical Co., Ltd.). In particular, the primary amine is preferred. The secondary or tertiary amine that is substituted with a methyl group, an ethyl group, or a phenyl group has weak polarity and is less effective for the charge build-up property of the toner. When the amino group is replaced with an aminomethyl group, an aminoethyl group, or an aminophenyl group, the end of a straight chain extended from silane of the silane coupling agent can be the primary amine. However, the amino group contained in the organic group of the straight chain does not contribute to the charge build-up property and is affected by moisture under high humidity. Therefore, although the carrier may have charging ability for the initial toner because the amino group is at the end, the charging ability is decreased during printing, resulting in a short life of the carrier.

By using the above aminosilane coupling agent with the fluorine modified silicone resin of this embodiment, the toner can be charged negatively while maintaining a sharp charge distribution. When the toner is supplied, it shows a quick rise in charge, and thus the toner consumption can be reduced. Moreover, the aminosilane coupling agent has the effect comparable to that of a cross-linking agent, and therefore can increase the degree of cross-linking of the coating of fluorine modified silicone resin as a base resin. The hardness of the resin coating is improved further, so that abrasion or peeling can be reduced over a long period of use. Accordingly, higher resistance to spent can be obtained, and the electrification can be stabilized by suppressing a decrease in the charging ability of the carrier, thus improving the durability.

When wax having a low melting point is added to toner with the above configuration in an amount greater than a predetermined value, the chargeability of the toner is rather unstable because the toner surface consists mainly of resin. There may be some cases where the chargeability is weaker and the rise in charge is slower. This tends to cause fog, poor uniformity of a solid image, and transfer voids or skipping in characters during transfer. However, combining the toner with the carrier of this embodiment can overcome these problems and improve the handling property of the toner in a developing unit. Thus, the uniformity in density of an image can be improved at both the start and end of the development. Moreover, a so-called developing memory, i.e., a history that is left after taking a solid image, can be reduced.

The ratio of the aminosilane coupling agent to the resin is 5 to 40 wt %, and preferably 10 to 30 wt %. When the ratio is less than 5 wt %, no effect of the aminosilane coupling agent is observed. When the ratio is more than 40 wt %, the degree of cross-linking of the resin coating is excessively high, and a charge-up phenomenon is likely to occur. This may lead to image defects such as underdevelopment.

The resin coating also may include conductive fine powder to stabilize the electrification and to prevent charge-up. Examples of the conductive fine powder include carbon black such as oil furnace black or acetylene black, a semiconductive oxide such as titanium oxide or zinc oxide, and powder of titanium oxide, zinc oxide, barium sulfate, aluminum borate, or potassium titanate coated with tin oxide, carbon black, or metal. The specific resistance is preferably not more than $10^{10}$ Ω·cm. The content of the conductive fine powder is preferably 1 to 15 wt %. When the conductive fine powder is included to some extent in the resin coating, the hardness of the resin coating can be improved by a filler effect. However, when the content is more than 15 wt %, the conductive fine powder may interfere with the formation of the resin coating, resulting in lower adherence and hardness. An excessive amount of conductive fine powder in a full color developer may cause the color contamination of the toner that is transferred and fixed on a paper.

The carrier used in the present invention preferably has an average particle size of 20 to 70 μm. When the average particle size is less than 20 μm, the abundance ratio of fine particles in the carrier particle distribution is increased, and the magnetization per carrier particle is reduced. Therefore, the carrier is likely to be developed on a photoconductive member. When the average particle size is more than 70 μm, the specific surface area of the carrier particles is smaller, and the toner retaining ability is decreased to cause toner scattering. For full color images including many solid portions, the reproduction of the solid portions is particularly worse.

A method for forming a coating on the carrier core is not particularly limited, and any known coating methods can be used, such as a dipping method of dipping core material powder in a solution for forming a coating layer, a spraying method of spraying the solution for forming a coating layer on the surface of a core material, a fluidized bed method of spraying the solution for forming a coating layer to a core material while the core material is floated by fluidizing air, and a kneader and coater method of mixing a core material and the solution for forming a coating layer in a kneader and coater, and removing the solvent. In addition to these wet coating methods, a dry coating method also can be used. The dry coating method includes, e.g., mixing resin powder and a core material at high speed, and fusing the resin powder on the surface of the core material by utilizing the frictional heat. In particular, the wet coating method is preferred for coating of the fluorine modified silicone resin containing an aminosilane coupling agent of the present invention.

A solvent of the solution for forming a coating layer is not particularly limited as long as it dissolves the coating resin, and can be selected in accordance with the coating resin to be used. Examples of the solvent include aromatic hydrocarbons such as toluene and xylene, ketones such as acetone and methyl ethyl ketone, and ethers such as tetrahydrofuran and dioxane.

The amount of coating resin is preferably 0.2 to 6.0 wt %, more preferably 0.5 to 5.0 wt %, further preferably 0.6 to 4.0 wt %, and most preferably 0.7 to 3 wt % with respect to the carrier core. When the amount of coating resin is less than 0.2 wt %, a uniform coating cannot be formed on the carrier surface. Therefore, the carrier is affected significantly by the characteristics of the carrier core and cannot provide a sufficient effect of the fluorine modified silicone resin containing an aminosilane coupling agent. When the amount of coating resin is more than 6.0 wt %, the coating is too thick, and granulation between the carrier particles occurs. Therefore, the carrier particles are not likely to be uniform.

It is preferable that a baking treatment is performed after coating the carrier core with the fluorine modified silicone resin containing an aminosilane coupling agent. A means for the baking treatment is not particularly limited, and either of external and internal heating systems may be used. For example, a fixed or fluidized electric furnace, a rotary kiln electric furnace, or a burner furnace can be used as well. Alternatively, baking may be performed with a microwave. The baking temperature should be high enough to provide the effect of the fluorine modified silicone that can improve the spent resistance of the resin coating, e.g., preferably 200° C. to 350° C., and more preferably 220° C. to 280° C. The treatment time is preferably 1.5 to 2.5 hours. A lower temperature may degrade the hardness of the resin coating itself, while an excessively high temperature may cause a charge reduction.

(9) Two-Component Development

Both direct-current bias and alternating-current bias are applied between a photoconductive member and a developing roller. In this case, it is preferable that the frequency is 1 to 10 kHz, the alternating-current bias is 1.0 to 2.5 kV (p-p), and the circumferential velocity ratio of the photoconductive member to the developing roller is 1:1.2 to 1:2.

More preferably, the frequency is 3.5 to 8 kHz, the alternating-current bias is 1.2 to 2.0 kV (p-p), and the circumferential velocity ratio of the photoconductive member to the developing roller is 1:1.5 to 1:1.8.

Further preferably, the frequency is 5.5 to 7 kHz, the alternating-current bias is 1.5 to 2.0 kV (p-p), and the circumferential velocity ratio of the photoconductive member to the developing roller is 1:1.6 to 1:1.8.

By using the above development process configuration with the toner or two-component developer of this embodiment, dots can be reproduced faithfully, the development gamma-characteristics can be improved, and a high quality image and the oilless fixability can be achieved together. Moreover, charge-up can be suppressed under low humidity even with a high resistance carrier. Therefore, high image density can be obtained over continuous use.

Even if the toner surface consists mainly of resin, the adhesion between the toner and the carrier can be reduced by using the carrier composition of this embodiment with the alternating-current bias. Moreover, it is possible to maintain the image density, to reduce fog, and to reproduce dots faithfully.

When the frequency is less than 1 kHz, the dot reproducibility is decreased, resulting in poor reproduction of middle tones. When the frequency is more than 10 kHz, the toner cannot follow in the development region, and no effect is observed. In the two-component development using a high resistance carrier, the frequency within the above range is more effective for reciprocating action between the carrier and the toner than between the developing roller and the photoconductive member. Thus, the toner can be liberated slightly from the carrier. This improves the dot reproducibility and the middle tone reproducibility, and also provides high image density.

When the alternating-current bias is lower than 1.0 kV (p-p), the effect of suppressing charge-up cannot be obtained. When the alternating-current bias is more than 2.5 kV (p-p), fog is increased. When the circumferential velocity ratio is less than 1:1.2 (the developing roller gets slower), it is difficult to ensure the image density. When the circumferential velocity ratio is more than 1:2 (the developing roller gets faster), toner scattering is increased.

(10) Tandem Color Process

This embodiment employs the following transfer process for high-speed color image formation. A plurality of toner image forming stations, each of which includes a photoconductive member, a charging member, and a toner support member, are used. In a primary transfer process, an electrostatic latent image formed on the photoconductive member is made visible by development, and a toner image thus developed is transferred to an endless transfer member that is in contact with the photoconductive member. The primary transfer process is performed continuously in sequence so that a multilayer toner image is formed on the transfer member. Then, a secondary transfer process is performed by collectively transferring the multilayer toner image from the transfer member to a transfer medium such as a paper or OHP sheet. The transfer process satisfies the relationship expressed by $$d1/v \leqq 0.65$$

where d1 (mm) is a distance between the first primary transfer position and the second primary transfer position, and v (mm/s) is a circumferential velocity of the photoconductive member. This configuration can reduce the machine size and improve the printing speed. To process at least 20 sheets (A4) per minute and to make the size small enough to be used for SOHO (small office/home office) purposes, a distance between the toner image forming stations should be as short as possible, while the processing speed should be enhanced. Thus, d1/v≦0.65 is considered as the minimum requirement to achieve both small size and high printing speed.

However, when the distance between the toner image forming stations is too short, e.g., when a period of time from the primary transfer of the first color (yellow toner) to that of the second color (magenta toner) is extremely short, the charge of the transfer member or the charge of the transferred toner hardly is relieved. Therefore, when the magenta toner is transferred onto the yellow toner, it is repelled by the charging action of the yellow toner. This may lead to lower transfer efficiency and transfer voids. When the third color (cyan) toner is transferred onto the yellow and the magenta toner, the cyan toner may be scattered to cause a transfer failure or considerable transfer voids. Moreover, toner having a specified particle size is developed selectively with repeated use, and the individual toner particles differ significantly in flowability, so that frictional charge characteristics are different. Thus, the charge amount is varied and further reduces the transfer property.

In such a case, therefore, the toner or two-component developer of this embodiment can be used to stabilize the charge distribution and suppress the overcharge and flowability variations. Accordingly, it is possible to prevent lower transfer efficiency, transfer voids, and reverse transfer without sacrificing the fixing property.

(11) Oilless Color Fixing

The toner of this embodiment can be used preferably in an electrographic apparatus having a fixing process with an oilless fixing configuration that applies no oil to any fixing means. As a heating means, electromagnetic induction heating is suitable in view of reducing a warm-up time and power consumption. The oilless fixing configuration includes a magnetic field generation means and a heating and pressing means. The heating and pressing means includes a rotational heating member and a rotational pressing member. The rotational heating member includes at least a heat generation layer for generating heat by electromagnetic induction and a release layer. There is a certain nip between the rotational heating member and the rotational pressing member. The toner that has been transferred to a transfer medium such as copy paper is fixed by passing the transfer medium between the rotational heating member and the rotational pressing member. This configuration is characterized by the warm-up time of the rotational heating member that has a quick rising property as compared with a conventional configuration using a halogen lamp. Therefore, the copying operation starts before the temperature of the rotational pressing member is raised sufficiently. Thus, the toner is required to have the low-temperature fixability and a wide range of the offset resistance.

Another configuration in which a heating member is separated from a fixing member and a fixing belt runs between the two members also may be used preferably. The fixing belt may be, e.g., a nickel electroformed belt having heat resistance and deformability or a heat-resistant polyimide belt. Silicone rubber, fluorocarbon rubber, or fluorocarbon resin may be used as a surface coating to improve the releasability.

In the conventional fixing process, release oil has been applied to prevent offset. The toner that exhibits releasability without using oil can eliminate the need for application of the release oil. However, if the release oil is not applied to the fixing means, it can be charged easily. Therefore, when an unfixed toner image is close to the heating member or the fixing member, the toner may be scattered due to the influence of charge. Such scattering is likely to occur particularly under low temperature and low humidity.

In contrast, the toner of this embodiment can achieve the low-temperature fixability and a wide range of the offset resistance without using oil. The toner also can provide high color transmittance. Thus, the use of the toner of this embodiment can suppress overcharge as well as scattering caused by the charging action of the heating member or the fixing member.

EXAMPLES

Hereinafter, the present invention will be described in more detail by way of examples. However, the present invention is not limited to the examples.

Example 1

Carrier Producing Example 1

MnO (39.7 mol %), MgO (9.9 mol %), $Fe_2O_3$ (49.6 mol %), and SrO (0.8 mol %) were placed in a wet ball mill, and then were pulverized and mixed for 10 hours. The resultant mixture was dried, kept at 950° C. for 4 hours, and calcinated. This was pulverized for 24 hours in a wet ball mill, and then was granulated and dried by a spray dryer. The granulated substance was kept in an electric furnace at 1270° C. for 6 hours in an atmosphere having an oxygen concentration of 2%, and calcinated. The fired substance was ground and further classified, thus producing a core material of ferrite particles that had an average particle size of 50 μm and a saturation magnetization of 65 emu/g in an applied magnetic field of 3000 oersted.

Next, 250 g of polyorganosiloxane expressed by Chemical Formula (5) in which $R^1$ and $R^2$ are a methyl group, i.e., $(CH_3)_2SiO_{2/2}$ unit is 15.4 mol % and Chemical Formula (6) in which $R^3$ is a methyl group, i.e., $CH_3SiO_{3/2}$ unit is 84.6 mol % was allowed to react with 21 g of $CF_3CH_2CH_2Si(OCH_3)_3$ to produce a fluorine modified silicone resin. Then, 100 g of the fluorine modified silicone resin (as represented in terms of solid content) and 10 g of aminosilane coupling agent (γ-aminopropyltriethoxysilane) were weighed and dissolved in 300 cc of toluene solvent.

Chemical Formula (5):

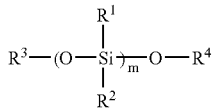

(where $R^1$, $R^2$, $R^3$, and $R^4$ are a methyl group, and m is a mean degree of polymerization of 100)

Chemical Formula (6):

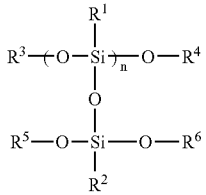

(where $R^1$, $R^2$, $R^3$, $R^4$, $R^5$, and $R^6$ are a methyl group, and n is a mean degree of polymerization of 80)

Using a dip and dry coater, 10 kg of the ferrite particles were coated by stirring the resin coating solution for 20 minutes, and then were baked at 260° C. for 1 hour, providing a carrier A1.

Carrier Producing Example 2

A core material was produced in the same manner as the Carrier Producing Example 1 except that $CF_3CH_2CH_2Si(OCH_3)_3$ was changed to $C_8F_{17}CH_2CH_2Si(OCH_3)_3$, and a coating was applied, thus providing a carrier A2.

Carrier Producing Example 3

A core material was produced in the same manner as the Carrier Producing Example 1 except that a conductive carbon (EC manufactured by Ketjenblack International Corporation) was dispersed in an amount of 5 wt % per the resin solid content by using a pearl mill, and a coating was applied, thus providing a carrier A3.

Carrier Producing Example 4

A core material was produced in the same manner as the Carrier Producing Example 3 except that the amount of aminosilane coupling agent was changed to 30 g, and a coating was applied, thus providing a carrier A4.

Carrier Producing Example 5

A core material was produced in the same manner as the Carrier Producing Example 3 except that the amount of aminosilane coupling agent was changed to 50 g, and a coating was applied, thus providing a carrier b1.

Carrier Producing Example 6

As a coating resin, 100 g of straight silicone (SR-2411 manufactured by Dow Corning Toray Silicone Co., Ltd.) was weighed in terms of solid content and dissolved in 300 cc of toluene solvent. Using a dip and dry coater, 10 kg of the ferrite particles were coated by stirring the resin coating solution for 20 minutes, and then were baked at 210° C. for 1 hour, providing a carrier b2.

Carrier Producing Example 7

As a coating resin, 100 g of perfluorooctylethyl acrylate/methacrylate copolymer was weighed in terms of solid content and dissolved in 300 cc of toluene solvent. Using a dip and dry coater, 10 kg of the ferrite particles were coated by stirring the resin coating solution for 20 minutes, and then were baked at 200° C. for 1 hour, providing a carrier b3.

Carrier Producing Example 8

As a coating resin, 100 g of acrylic modified silicone resin (KR-9706 manufactured by Shin-Etsu Chemical Co., Ltd.) was weighed in terms of solid content and dissolved in 300 cc of toluene solvent. Using a dip and dry coater, 10 kg of the ferrite particles were coated by stirring the resin coating solution for 20 minutes, and then were baked at 210° C. for 1 hour, providing a carrier b4.

Example 2

Resin Dispersion Production

Table 1 shows the characteristics of the resins used. In Table 1, Mn is a number-average molecular weight, Mw is a weight-average molecular weight, Mz is a Z-average molecular weight, Mp is a peak value of the molecular weight, Tm (° C.) is a softening point, and Tg (° C.) is a glass transition point. The values for styrene, n-butylacrylate, and acrylic acid indicate the mixing amount (g).

(1) Preparation of Resin Particle Dispersion RL1

A monomer solution including 96 g of styrene, 24 g of n-butylacrylate, and 3.6 g of acrylic acid was dispersed in 200 g of ion-exchanged water with 3 g of anionic surface-active agent (NEOGEN RK manufactured by Dai-Ichi Kogyo Seiyaku Co., Ltd.), 6 g of dodecanethiol, and 1.2 g of carbon tetrabromide. Then, 1.2 g of potassium persulfate was added to the resultant solution, and emulsion polymerization was performed at 70° C. for 6 hours. Thus, a resin particle dispersion RL1 was prepared, in which the resin particles having Mn of 3900, Mw of 10900, Mz of 37800, Mp of 8100, Tm of 115° C., Tg of 43° C., and a median diameter of 0.12 μm were dispersed.

(2) Preparation of Resin Particle Dispersion RL2

A monomer solution including 204 g of styrene, 36 g of n-butylacrylate, and 3.6 g of acrylic acid was dispersed in 400 g of ion-exchanged water with 6 g of anionic surface-active agent (NEOGEN RK manufactured by Dai-Ichi Kogyo Seiyaku Co., Ltd.), 6 g of dodecanethiol, and 1.2 g of carbon tetrabromide. Then, 1.2 g of potassium persulfate was added to the resultant solution, and emulsion polymerization was performed at 70° C. for 5 hours. Thus, a resin particle dispersion RL2 was prepared, in which the resin particles having Mn of 6600, Mw of 60300, Mz of 259000, Mp of 8100, Tm of 128° C., Tg of 55° C., and a median diameter of 0.18 μm were dispersed.

(3) Preparation of Resin Particle Dispersion RL3

A monomer solution including 204 g of styrene, 36 g of n-butylacrylate, and 3.6 g of acrylic acid was dispersed in 400 g of ion-exchanged water with 6 g of anionic surface-active agent (NEOGEN RK manufactured by Dai-Ichi Kogyo Seiyaku Co., Ltd.), 12 g of dodecanethiol, and 2.4 g of carbon tetrabromide. Then, 1.2 g of potassium persulfate was added to the resultant solution, and emulsion polymerization was performed at 70° C. for 5 hours. Thus, a resin particle dispersion RL3 was prepared, in which the resin particles having Mn of 2600, Mw of 18300, Mz of 96200, Mp of 2700, Tm of 109° C., Tg of 45° C., and a median diameter of 0.18 μm were dispersed.

(4) Preparation of Resin Particle Dispersion RH4

A monomer solution including 102 g of styrene, 18 g of n-butylacrylate, and 1.8 g of acrylic acid was dispersed in 200 g of ion-exchanged water with 3 g of anionic surface-active agent (NEOGEN RK manufactured by Dai-Ichi Kogyo Seiyaku Co., Ltd.), while neither dodecanethiol nor carbon tetrabromide was used. Then, 1.2 g of potassium persulfate was added to the resultant solution, and emulsion polymerization was performed at 70° C. for 5 hours. Thus, a resin particle dispersion RH4 was prepared, in which the resin particles having Mn of 43300, Mw of 262000, Mz of 577000, Mp of 182000, Tm of 197° C., Tg of 77° C., and a median diameter of 0.12 μm were dispersed.

TABLE 1

| | Mn ($\times 10^4$) | Mw ($\times 10^4$) | Mz ($\times 10^4$) | Wm = Mw/Mn | Wz = Mz/Mn | Mp ($\times 10^4$) | T g (° C.) | T m (° C.) | styrene | n-butyl acrylate | acrylic acid |
|---|---|---|---|---|---|---|---|---|---|---|---|
| RL1 | 0.39 | 1.09 | 3.78 | 2.79 | 9.69 | 0.81 | 43 | 115 | 96 | 24 | 3.6 |
| RL2 | 0.66 | 6.03 | 25.9 | 9.14 | 39.24 | 0.81 | 55 | 128 | 204 | 36 | 3.6 |
| RL3 | 0.26 | 1.83 | 9.62 | 7.04 | 37.00 | 0.27 | 45 | 109 | 204 | 36 | 3.6 |
| RH4 | 4.33 | 26.2 | 57.7 | 6.05 | 13.33 | 18.2 | 77 | 197 | 102 | 18 | 1.8 |
| RH5 | 4.1 | 24.2 | 57.5 | 5.90 | 14.02 | 15.4 | 76 | 193 | 102 | 18 | 1.8 |

(5) Preparation of Resin Particle Dispersion RH5

A monomer solution including 102 g of styrene in which 4 g of salicylic acid aluminum metal complex (E88 manufactured by Orient Chemical Industries, Ltd.) was melted, 18 g of n-butylacrylate, and 1.8 g of acrylic acid was dispersed in 200 g of ion-exchanged water with 3 g of anionic surface-active agent (NEOGEN RK manufactured by Dai-Ichi Kogyo Seiyaku Co., Ltd.), while neither dodecanethiol nor carbon tetrabromide was used. Then, 1.2 g of potassium persulfate was added to the resultant solution, and emulsion polymerization was performed at 70° C. for 5 hours. Thus, a resin particle dispersion RH5 was prepared, in which the resin particles having Mn of 41000, Mw of 242000, Mz of 575000, Mp of 154000, Tm of 193° C., Tg of 76° C., and a median diameter of 0.22 μm were dispersed.

Example 3

Pigment Dispersion Production

Table 2 shows the pigments used.

TABLE 2

| | |
|---|---|
| PM1 | KETRED309 (Dainippon Ink and Chemicals, Inc.) |
| PC1 | KETBLUE111 (Dainippon Ink and Chemicals, Inc.) |
| PY1 | Y180 (Clariant) |
| PB1 | MA100S (Mitsubishi Chemical Corporation) |

(1) Preparation of Colorant Particle Dispersion PM1

20 g of magenta pigment (KETRED309 manufactured by Dainippon Ink and Chemicals, Inc.), 2 g of anionic surface-active agent (NEOGEN R manufactured by Dai-Ichi Kogyo Seiyaku Co., Ltd), and 78 g of ion-exchanged water were mixed and dispersed by using an ultrasonic dispersing device at an oscillation frequency of 30 kHz for 20 minutes. Thus, a colorant particle dispersion PM1 was prepared, in which the colorant particles having a median diameter of 0.12 μm were dispersed.

(2) Preparation of Colorant Particle Dispersion PC1

20 g of cyan pigment (KETBLUE111 manufactured by Dainippon Ink and Chemicals, Inc.), 2 g of anionic surface-active agent (NEOGEN R manufactured by Dai-Ichi Kogyo Seiyaku Co., Ltd), and 78 g of ion-exchanged water were mixed and dispersed by using an ultrasonic dispersing device at an oscillation frequency of 30 kHz for 20 minutes. Thus, a colorant particle dispersion PC1 was prepared, in which the colorant particles having a median diameter of 0.12 μm were dispersed.

(3) Preparation of Colorant Particle Dispersion PY1

20 g of yellow pigment (Y180 manufactured by Clariant), 2 g of anionic surface-active agent (NEOGEN R manufactured by Dai-Ichi Kogyo Seiyaku Co., Ltd), and 78 g of ion-exchanged water were mixed and dispersed by using an ultrasonic dispersing device at an oscillation frequency of 30 kHz for 20 minutes. Thus, a colorant particle dispersion PY1 was prepared, in which the colorant particles having a median diameter of 0.12 μm were dispersed.

(4) Preparation of Colorant Particle Dispersion PB1

20 g of black pigment (MA100S manufactured by Mitsubishi Chemical Corporation), 2 g of anionic surface-active agent (NEOGEN R manufactured by Dai-Ichi Kogyo Seiyaku Co., Ltd), and 78 g of ion-exchanged water were mixed and dispersed by using an ultrasonic dispersing device at an oscillation frequency of 30 kHz for 20 minutes. Thus, a colorant particle dispersion PB1 was prepared, in which the colorant particles having a median diameter of 0.12 μm were dispersed.

Example 4

Wax Dispersion Production

Tables 3, 4, 5, and 6 show the characteristics of the waxes used.

TABLE 3

| Wax | Material | Melting point Tmw(° C.) | Volume ratio Ct (%) | Heating loss Ck (wt %) | Iodine value | Saponification value |
|---|---|---|---|---|---|---|
| W-1 | Hydrogenated jojoba oil | 68 | 18.5 | 2.8 | 2 | 95.7 |
| W-2 | Carnauba wax | 83 | 15.3 | 4.1 | 10 | 80 |
| W-3 | Hydrogenated meadowfoam oil | 71 | 3 | 2.5 | 2 | 90 |
| W-5 | Glycerol triester (hydrogenated castor oil) | 85 | | 1.9 | 3 | 180 |
| W-6 | Saturated hydrocarbon wax (FNP0090 manufactured by Nippon Seiro Co., Ltd.) | 90.2 | | | | |

TABLE 4

| | | Melting point Tmw(° C.) | Acid value | Penetration number |
|---|---|---|---|---|
| W-4 | Polypropylene/maleic anhydride/alcohol-type wax with a carbon number of 30 or less/tert-butyl-peroxy isopropyl monocarbonate: 100/20/8/4 parts by weight | 98 | 45 | 1 |

TABLE 5

| | Mnw | Mww | Mzw | Mww/Mnw | Mzw/Mnw | Mpw |
|---|---|---|---|---|---|---|
| W-1 | 1009 | 1072 | 1118 | 1.06 | 1.11 | $1.02 \times 10^3$ |
| W-2 | 1100 | 1198 | 1290 | 1.09 | 1.17 | $1.2 \times 10^3$ |
| W-3 | 1015 | 1078 | 1124 | 1.06 | 1.11 | $1.03 \times 10^3$ |
| W-4 | 1400 | 2030 | 2810 | 1.45 | 2.01 | $2.1 \times 10^3$ |

TABLE 5-continued

| | Mnw | Mww | Mzw | Mww/Mnw | Mzw/Mnw | Mpw |
|---|---|---|---|---|---|---|
| W-5 | 1050 | 1120 | 1290 | 1.07 | 1.23 | $3.1 \times 10^3$ |
| W-6 | 1240 | 2100 | 2760 | 1.69 | 2.23 | $1.4 \times 10^3$ |

TABLE 6

| Dispersion | Wax used | PR16(nm) | PR50(nm) | PR84(nm) | PR84/PR16 |
|---|---|---|---|---|---|
| WA1 | W-1 | 29 | 43.5 | 58 | 2.00 |
| WA2 | W-2 | 64 | 92 | 120 | 1.88 |
| WA3 | W-2 | 32 | 45 | 58 | 1.81 |
| WA4 | W-3 | 32 | 37 | 42 | 1.31 |
| WA5 | W-4 | 115 | 152 | 189 | 1.64 |
| WA6 | W-1 | 50 | 74 | 98 | 1.96 |
| WA7 | W-4 | 74 | 94 | 114 | 1.54 |
| WA8 | W-5 | 112 | 168 | 224 | 2.00 |
| WA9 | W-6 | 125 | 187 | 249 | 1.99 |
| wa10 | | 230 | 360 | 490 | 2.13 |
| wa11 | | 240 | 410 | 580 | 2.42 |
| wa12 | | 470 | 760 | 1050 | 2.23 |

(1) Preparation of Wax Particle Dispersion WA1

FIG. 3 is a schematic view of a stirring/dispersing device, and FIG. 4 is a plan view of the same. As shown in FIG. 3, cooling water is introduced from 808 to the inside of an outer tank 801 and then is discharged from 807. Reference numeral 802 is a shielding board that stops the flow of the liquid to be treated. The shielding board 802 has an opening in the central portion, and the treated liquid is drawn from the opening and taken out of the device through 805. Reference numeral 803 is a rotating body that is secured to a shaft 806 and rotates at high speed. There are holes (about 1 to 5 mm in size) in the side of the rotating body 803, and the liquid to be treated can move through the holes. The liquid to be treated is put into the tank in an amount of about one-half the capacity (120 ml) of the tank. The rotational speed of the rotating body 803 is 50 m/s. The rotating body 803 has a diameter of 52 mm, and the tank 801 has an internal diameter of 56 mm. Reference numeral 804 is a material inlet used for a continuous treatment. In the case of a batch treatment, the material inlet 804 is closed.

68 g of ion-exchanged water, 1 g of anionic surface-active agent (SCF manufactured by Sanyo Chemical Industries, Ltd.), 1 g of nonionic surface-active agent (Newcol 565C manufactured by Nippon Nyukazai Co., Ltd), and 28 g of wax (W-1) were blended and treated while the rotating body rotated at a rotational speed of 20 m/s for 5 minutes, and then 50 m/s for 5 minutes. The liquid temperature in the tank was increased to 92° C., and the wax was melted by heat thus generated. Moreover, a strong shearing force was exerted on the liquid, thereby providing a fine wax particle dispersion WA1.

(2) Preparation of Wax Particle Dispersion WA2

Under the same conditions as (1), 68 g of ion-exchanged water, 1 g of anionic surface-active agent (SCF manufactured by Sanyo Chemical Industries, Ltd.), 1 g of nonionic surface-active agent (Newcol 565C manufactured by Nippon Nyukazai Co., Ltd), and 28 g of wax (W-2) were blended and treated while the rotating body rotated at a rotational speed of 20 m/s for 3 minutes, and then 45 m/s for 5 minutes. Thus, a wax particle dispersion WA2 was provided.

(3) Preparation of Wax Particle Dispersion WA3

Under the same conditions as (1), 68 g of ion-exchanged water, 1 g of anionic surface-active agent (SCF manufactured by Sanyo Chemical Industries, Ltd.), 1 g of nonionic surface-active agent (Newcol 565C manufactured by Nippon Nyukazai Co., Ltd), and 28 g of wax (W-2) were blended and treated while the rotating body rotated at a rotational speed of 20 m/s for 3 minutes, and then 50 m/s for 4 minutes. Thus, a wax particle dispersion WA3 was provided.

(4) Preparation of Wax Particle Dispersion WA4

FIG. 5 is a schematic view of a stirring/dispersing device, and FIG. 6 is a plan view of the same. Reference numeral 850 is an inlet and 852 is a stator with a floating structure. The stator 852 is pressed down by springs 851, but pushed up by a force created when a rotor 853 rotates at high speed. Therefore, a narrow gap of about 1 μm to 10 μm is formed between the stator 852 and the rotor 853. Reference numeral 854 is a shaft connected to a motor (not shown). Materials are fed into the device from the inlet 850, subjected to a strong shearing force in the gap between the stator 852 and the rotor 853, and thus formed into fine particles dispersed in the liquid. The material liquid thus treated is drawn from outlets 856. As shown in FIG. 6, the material liquid 855 is released radially and collected in a closed container. The rotor 853 has an outer diameter of 100 mm.

The material liquid, in which wax and a surface-active agent were predispersed in a heated aqueous medium, was introduced from the inlet 850 and treated instantaneously to make a fine particle dispersion. The amount of material liquid supplied was 1 kg/h, and the rotational speed of the rotor 853 was 100 m/s.

68 ml of ion-exchanged water, 1 g of anionic surface-active agent (SCF manufactured by Sanyo Chemical Industries, Ltd.), 1 g of nonionic surface-active agent (Newcol 565C manufactured by Nippon Nyukazai Co., Ltd), and 28 g of wax (W-3) were blended and treated in a supplied amount of 1 kg/h while the rotor rotated at a rotational speed of 100 m/s. Thus, a wax particle dispersion WA4 was provided.

(5) Preparation of Wax Particle Dispersion WA5

Under the same conditions as (1), 68 g of ion-exchanged water, 1 g of anionic surface-active agent (SCF manufactured by Sanyo Chemical Industries, Ltd.), 1 g of nonionic surface-active agent (Newcol 565C manufactured by Nippon Nyukazai Co., Ltd), and 28 g of wax (W-4) were blended and treated while the rotating body rotated at a rotational speed of 20 m/s for 3 minutes, and then 40 m/s for 4 minutes. Thus, a wax particle dispersion WA5 was provided.

(6) Preparation of Wax Particle Dispersion WA6

Under the same conditions as (4), 68 g of ion-exchanged water, 1 g of anionic surface-active agent (SCF manufactured by Sanyo Chemical Industries, Ltd.), 1 g of nonionic surface-active agent (Newcol 565C manufactured by Nippon Nyukazai Co., Ltd), and 28 g of wax (W-1) were blended and treated while the rotor rotated at a rotational speed of 90 m/s. Thus, a wax particle dispersion WA6 was provided.

(7) Preparation of Wax Particle Dispersion WA7

Under the same conditions as (1), 68 g of ion-exchanged water, 1 g of anionic surface-active agent (SCF manufactured by Sanyo Chemical Industries, Ltd.), 1 g of nonionic surface-active agent (Newcol 565C manufactured by Nippon Nyukazai Co., Ltd), and 28 g of wax (W-4) were blended and treated while the rotating body rotated at a rotational speed of 20 m/s for 3 minutes, and then 40 m/s for 4 minutes. Thus, a wax particle dispersion WA7 was provided.

(8) Preparation of Wax Particle Dispersion WA8

Under the same conditions as (1), 68 g of ion-exchanged water, 1 g of anionic surface-active agent (SCF manufactured by Sanyo Chemical Industries, Ltd.), 1 g of nonionic surface-active agent (Newcol 565C manufactured by Nippon Nyukazai Co., Ltd), and 28 g of wax (W-5) were blended and treated while the rotating body rotated at a rotational speed of 20 m/s for 3 minutes, and then 50 m/s for 2 minutes. Thus, a wax particle dispersion WA8 was provided.

(9) Preparation of Wax Particle Dispersion WA9

Under the same conditions as (1), 68 g of ion-exchanged water, 1 g of anionic surface-active agent (SCF manufactured by Sanyo Chemical Industries, Ltd.), 1 g of nonionic surface-active agent (Newcol 565C manufactured by Nippon Nyukazai Co., Ltd), and 28 g of wax (W-6) were blended and treated while the rotating body rotated at a rotational speed of 20 m/s for 3 minutes, and then 50 m/s for 2 minutes. Thus, a wax particle dispersion WA9 was provided.

(10) Preparation of Wax Particle Dispersion wa10

Under the same conditions as (1), 68 ml of ion-exchanged water, 1 g of anionic surface-active agent (SCF manufactured by Sanyo Chemical Industries, Ltd.), 1 g of nonionic surface-active agent (Newcol 565C manufactured by Nippon Nyukazai Co., Ltd), and 28 g of paraffin wax (HNP-10 (melting point: 75° C) manufactured by Nippon Seiro Co., Ltd.) were blended and treated while the rotating body rotated at a rotational speed of 20 m/s for 5 minutes. Thus, a wax particle dispersion wa10 was provided.

(11) Preparation of Wax Particle Dispersion wa11

Under the same conditions as (1), 68 ml of ion-exchanged water, 1 g of anionic surface-active agent (SCF manufactured by Sanyo Chemical Industries, Ltd.), 1 g of nonionic surface-active agent (Newcol 565C manufactured by Nippon Nyukazai Co., Ltd), and 28 g of Fischer-Tropsch wax (FT0070 (melting point: 72° C.) manufactured by Nippon Seiro Co., Ltd.) were blended and treated while the rotating body rotated at a rotational speed of 25 m/s for 5 minutes. Thus, a wax particle dispersion wa11 was provided.

(12) Preparation of Wax Particle Dispersion wa12

68 ml of ion-exchanged water, 1 g of anionic surface-active agent (SCF manufactured by Sanyo Chemical Industries, Ltd.), 1 g of nonionic surface-active agent (Newcol 565C manufactured by Nippon Nyukazai Co., Ltd), and 28 g of hydrocarbon wax (LUVAX2191 (melting point: 83° C.) manufactured by Nippon Seiro Co., Ltd.) were blended and treated for 30 minutes by using a homogenizer. Thus, a wax particle dispersion wa12 was provided.

Example 5

Toner Base Production

Table 7 shows the toner compositions. In Table 7, the numbers in parentheses indicate a mixing ratio (%) of two types of wax dispersions.

(1) Preparation of Toner Base M1

In a 2000 ml four-neck flask equipped with a cooling tube and a thermometer were placed 204 g of resin particle dispersion RL2, 20 g of colorant particle dispersion PM1 (20 wt % concentration), 50 g of wax particle dispersion WA1 (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 9 by adding 1N NaOH to the mixed particle dispersion. Subsequently, 200 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. Then, the temperature was raised to 76° C., and the mixture further was heat-treated for 5 hours to provide aggregated and associated particles. After cooling, the reaction product (toner base) was filtered and washed three times with ion-exchanged water. The toner base thus obtained was dried at 40° C. for 6 hours by using a fluid-type dryer, resulting in a toner base M1. The observation with a Coulter Counter (Multisizer 2 manufactured by Coulter Electronics, Inc.) showed that the toner base M1 had a volume-average particle size of 3.5 μm and a coefficient of variation of 22.8. The proportion of the second particles formed of the resin and the wax in the mixed and dispersed state was 58% by number.

In this case, when the pH was more than 13, the aggregation did not proceed, the resin and wax particles were still liberated, and thus the particles were not formed successfully. When the pH was 7.5, the particle size was increased considerably (with a volume-average particle size of 12.5 μm and a coefficient of variation of 26.5). The proportion of the second particles was 32% by number.

When combined with the wax of the present invention, the pH value is preferably 8 to 12, more preferably 9 to 12, and further preferably 11 to 12.

When heating temperature was 65° C., the aggregation did not proceed, the resin and wax particles were still liberated, and thus the particles were not formed successfully. When the heating temperature was 85° C., the particle size was increased considerably (with a volume-average particle size of 14.5 μm and a coefficient of variation of 20.5). The proportion of the second particles was 28% by number.

(2) Preparation of Toner Base M2

In a 2000 ml four-neck flask equipped with a cooling tube and a thermometer were placed 204 g of resin particle disper-

TABLE 7

| | Resin dispersion 1 | Pigment dispersion | Wax dispersion | Wax dispersion | Resin dispersion 2 | Volume-based average particle size (μm) | Volume-based coefficient of variation |
|---|---|---|---|---|---|---|---|
| M1 | RL2 | PM1 | WA1 | | | 3.5 | 22.8 |
| M2 | RL1 | PM1 | WA2 | | RH4 | 5.4 | 20.6 |
| M3 | RL2 | PM1 | WA3 | | | 3.8 | 15.6 |
| M4 | RL3 | PM1 | WA4 | | RH4 | 5.9 | 14.5 |
| M5 | RL2 | PM1 | WA5 | | | 4.5 | 14.3 |
| M6 | RL1 | PM1 | WA6 | | RH5 | 6.1 | 22.1 |
| M7 | RL3 | PM1 | WA7 | | RH5 | 5.4 | 14.8 |
| M8 | RL1 | PM1 | WA1(40) | WA8(60) | RH5 | 4.8 | 18.9 |
| M9 | RL2 | PM1 | WA1(30) | WA9(70) | RH5 | 5.2 | 17.8 |
| M10 | RL3 | PM1 | WA2(20) | WA9(80) | RH5 | 5.5 | 16.8 |
| M11 | RL2 | PM1 | WA8(50) | WA9(50) | RH5 | 5.9 | 19.7 |
| m12 | RL2 | PM1 | wa10 | | | 14.5 | 28.8 |
| m13 | RL2 | PM1 | wa11 | | | 13.9 | 29 |
| m14 | RL2 | PM1 | wa12 | | | 13.6 | 32.1 |

sion RL1, 20 g of colorant particle dispersion PM1 (20 wt % concentration), 50 g of wax particle dispersion WA2 (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 9 by adding 1N NaOH to the mixed particle dispersion. Subsequently, 200 g of magnesium sulfate aqueous solution (30% concentration) was added and stirred for 10 minutes. After the temperature was raised from 22° C. to 86° C. at a rate of 5° C./min, the mixture was heat-treated at 86° C. for 2 hours. The pH was adjusted to 5.8 by the addition of 1N HCl. Then, the temperature was raised to 93° C., and the mixture further was heat-treated for 2 hours to provide aggregated and associated particles with a volume-average particle size of 4.2 μm and a coefficient of variation of 19.1. The proportion of the second particles was 62% by number.

After the water temperature was reduced to 60° C., 43 g of resin particle dispersion RH4 (20 wt % concentration) for forming a shell was added, followed by 43 g of magnesium sulfate aqueous solution (30% concentration). This mixture was heated at 90° C. for 0.5 hours, and then was heated at 90° C. for 2 hours. The pH was adjusted to 5.0 by the addition of 1N HCl, and the mixture further was heated at 90° C. for 5 hours. After cooling, the reaction product (toner base) was filtered and washed three times with ion-exchanged water. The toner base thus obtained was dried at 40° C. for 6 hours by using a fluid-type dryer, resulting in a toner base M2. The toner base M2 had a volume-average particle size of 5.4 μm and a coefficient of variation of 20.6.

(3) Preparation of Toner Base M3

In a 2000 ml four-neck flask equipped with a cooling tube and a thermometer were placed 204 g of resin particle dispersion RL2, 20 g of colorant particle dispersion PM1 (20 wt % concentration), 50 g of wax particle dispersion WA3 (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 9 by adding 1N NaOH to the mixed particle dispersion. Subsequently, 200 g of magnesium sulfate aqueous solution (30% concentration) was added and stirred for 10 minutes. After the temperature was raised from 22° C. to 75° C. at a rate of 5° C./min, the mixture was heat-treated at 75° C. for 2 hours. The pH was adjusted to 5.8 by the addition of 1N HCl. Then, the temperature was raised to 82° C., and the mixture further was heat-treated for 3 hours to provide aggregated and associated particles. After cooling, the reaction product (toner base) was filtered and washed three times with ion-exchanged water. The toner base thus obtained was dried at 40° C. for 6 hours by using a fluid-type dryer, resulting in a toner base M3. The toner base M3 had a volume-average particle size of 3.8 μm and a coefficient of variation of 15.6. Thus, the particle size distribution of M3 was sharper than that of M1. The proportion of the second particles was 82% by number.

(4) Preparation of Toner Base M4

In a 2000 ml four-neck flask equipped with a cooling tube and a thermometer were placed 204 g of resin particle dispersion RL3, 20 g of colorant particle dispersion PM1 (20 wt % concentration), 50 g of wax particle dispersion WA4 (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 10.5 by adding 1N NaOH to the mixed particle dispersion. Subsequently, 200 g of magnesium sulfate aqueous solution (30% concentration) was added and stirred for 10 minutes. After the temperature was raised from 22° C. to 74° C. at a rate of 5° C./min, the mixture was heat-treated at 74° C. for 2 hours. The pH was adjusted to 5.8 by the addition of 1N HCl. Then, the temperature was raised to 80° C., and the mixture further was heat-treated for 2 hours to provide aggregated and associated particles with a volume-average particle size of 4.1 μm and a coefficient of variation of 14.1. The proportion of the second particles was 80% by number.

After the water temperature was reduced to 60° C., the pH was adjusted to 8.3, and 43 g of resin particle dispersion RH4 for forming a shell was added, followed by 43 g of magnesium sulfate aqueous solution (30% concentration). This mixture was heated at 75° C. for 0.5 hours, and then was heated at 90° C. for 2 hours. The pH was adjusted to 5.0 by the addition of 1N HCl, and the mixture further was heated at 95° C. for 5 hours. After cooling, the reaction product (toner base) was filtered and washed three times with ion-exchanged water. The toner base thus obtained was dried at 40° C. for 6 hours by using a fluid-type dryer, resulting in a toner base M4. The toner base M4 had a volume-average particle size of 5.9 μm and a coefficient of variation of 14.5.

(5) Preparation of Toner Base M5

In a 2000 ml four-neck flask equipped with a cooling tube and a thermometer were placed 204 g of resin particle dispersion RL2, 20 g of colorant particle dispersion PM1 (20 wt % concentration), 50 g of wax particle dispersion WA5 (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 9 by adding 1N NaOH to the mixed particle dispersion. Subsequently, 200 g of magnesium sulfate aqueous solution (30% concentration) was added and stirred for 10 minutes. After the temperature was raised from 22° C. to 93° C. at a rate of 5° C./min, the mixture was heat-treated at 93° C. for 2 hours. The pH was adjusted to 5.8 by the addition of 1N HCl. While the flask was pressurized, the temperature was raised to 98° C., and the mixture further was heat-treated for 2 hours to provide aggregated and associated particles. After cooling, the reaction product (toner base) was filtered and washed three times with ion-exchanged water. The toner base thus obtained was dried at 40° C. for 6 hours by using a fluid-type dryer, resulting in a toner base M5. The toner base M5 had a volume-average particle size of 4.5 μm and a coefficient of variation of 14.3. The proportion of the second particles was 83% by number.

(6) Preparation of Toner Base M6

In a 2000 ml four-neck flask equipped with a cooling tube and a thermometer were placed 204 g of resin particle dispersion RL1, 20 g of colorant particle dispersion PM1 (20 wt % concentration), 50 g of wax particle dispersion WA6 (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 10 by adding 1N NaOH to the mixed particle dispersion. Subsequently, 200 g of magnesium sulfate aqueous solution (30% concentration) was added and stirred for 10 minutes. After the temperature was raised from 22° C. to 74° C. at a rate of 5° C./min, the mixture was heat-treated at 74° C. for 2 hours. Then, the temperature was raised to 80° C., and the mixture further was heat-treated for 2 hours to provide aggregated and associated particles with a volume-average particle size of 5.1 μm and a coefficient of variation of 22.4. The proportion of the second particles was 54% by number.

After the water temperature was reduced to 60° C., the pH was adjusted to 8.3, and 43 g of resin particle dispersion RH5 (20 wt % concentration) for forming a shell was added, followed by 43 g of magnesium sulfate aqueous solution (30% concentration). This mixture was heated at 75° C. for 0.5 hours, and then was heated at 90° C. for 2 hours. The pH was adjusted to 5.0 by the addition of 1N HCl, and the mixture further was heated at 95° C. for 5 hours. After cooling, the reaction product (toner base) was filtered and washed three times with ion-exchanged water. The toner base thus obtained was dried at 40° C. for 6 hours by using a fluid-type dryer, resulting in a toner base M6. The toner base M6 had a volume-average particle size of 6.1 μm and a coefficient of variation of 22.1.

(7) Preparation of Toner Base M7

In a 2000 ml four-neck flask equipped with a cooling tube and a thermometer were placed 204 g of resin particle dispersion RL3, 20 g of colorant particle dispersion PM1 (20 wt % concentration), 50 g of wax particle dispersion WA7 (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 10 by adding 1N NaOH to the mixed particle dispersion. Subsequently, 200 g of magnesium sulfate aqueous solution (30% concentration) was added and stirred for 10 minutes. After the temperature was raised from 22° C. to 74° C. at a rate of 5° C./min, the mixture was heat-treated at 74° C. for 2 hours. The pH was adjusted to 5.8 by the addition of 1N HCl. While the flask was pressurized, the temperature was raised to 98° C., and the mixture further was heat-treated for 3 hours to provide aggregated and associated particles with a volume-average particle size of 4.6 μm and a coefficient of variation of 15.2. The proportion of the second particles was 78% by number.

After the water temperature was reduced to 60° C., the pH was adjusted to 8.3, and 43 g of resin particle dispersion RH5 (20 wt % concentration) for forming a shell was added, followed by 43 g of magnesium sulfate aqueous solution (30% concentration). This mixture was heated at 75° C. for 0.5 hours, and then was heated at 90° C. for 2 hours. The pH was adjusted to 5.0 by the addition of 1N HCl, and the mixture further was heated at 95° C. for 5 hours. After cooling, the reaction product (toner base) was filtered and washed three times with ion-exchanged water. The toner base thus obtained was dried at 40° C. for 6 hours by using a fluid-type dryer, resulting in a toner base M7. The toner base M7 had a volume-average particle size of 5.4 μm and a coefficient of variation of 14.8.

(8) Preparation of Toner Base M8

In a 2000 ml four-neck flask equipped with a cooling tube and a thermometer were placed 204 g of resin particle dispersion RL1, 20 g of colorant particle dispersion PM1 (20 wt % concentration), 20 g of wax particle dispersion WA1 (30 wt % concentration), 30 g of wax particle dispersion WA8 (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 11.2 by adding 1N NaOH to the mixed particle dispersion. Subsequently, 200 g of magnesium sulfate aqueous solution (30% concentration) was added and stirred for 10 minutes. After the temperature was raised from 22° C. to 75° C. at a rate of 5° C./min, the mixture was heat-treated at 75° C. for 1 hour. Then, the temperature was raised to 90° C., and the mixture further was heat-treated for 3 hours to provide aggregated and associated particles with a volume-average particle size of 3.8 μm and a coefficient of variation of 20.4. The proportion of the second particles was 60% by number.

After the water temperature was reduced to 60° C., the pH was adjusted to 8.0, and 43 g of resin particle dispersion RH5 (20 wt % concentration) for forming a shell was added, followed by 43 g of magnesium sulfate aqueous solution (30% concentration). This mixture was heated at 75° C. for 0.5 hours, and then was heated at 90° C. for 3 hours. The pH was adjusted to 5.0 by the addition of 1N HCl, and the mixture further was heated at 95° C. for 2 hours. After cooling, the reaction product (toner base) was filtered and washed three times with ion-exchanged water. The toner base thus obtained was dried at 40° C. for 6 hours by using a fluid-type dryer, resulting in a toner base M8. The toner base M8 had a volume-average particle size of 4.8 μm and a coefficient of variation of 18.9.

(9) Preparation of Toner Base M9

In a 2000 ml four-neck flask equipped with a cooling tube and a thermometer were placed 204 g of resin particle dispersion RL2, 20 g of colorant particle dispersion PM1 (20 wt % concentration), 15 g of wax particle dispersion WA1 (30 wt % concentration), 35 g of wax particle dispersion WA9 (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 11.9 by adding 1N NaOH to the mixed particle dispersion. Subsequently, 200 g of magnesium sulfate aqueous solution (30% concentration) was added and stirred for 10 minutes. After the temperature was raised from 22° C. to 75° C. at a rate of 5° C./min, the mixture was heat-treated at 75° C. for 1 hour. Then, the temperature was raised to 95° C., and the mixture further was heat-treated for 3 hours to provide aggregated and associated particles with a volume-average particle size of 3.9 μm and a coefficient of variation of 19.4. The proportion of the second particles was 72% by number.

After the water temperature was reduced to 60° C., the pH was adjusted to 8.0, and 43 g of resin particle dispersion RH5 (20 wt % concentration) for forming a shell was added, followed by 43 g of magnesium sulfate aqueous solution (30% concentration). This mixture was heated at 75° C. for 0.5 hours, and then was heated at 90° C. for 3 hours. The pH was adjusted to 5.0 by the addition of 1N HCl, and the mixture further was heated at 95° C. for 2 hours. After cooling, the reaction product (toner base) was filtered and washed three times with ion-exchanged water. The toner base thus obtained was dried at 40° C. for 6 hours by using a fluid-type dryer, resulting in a toner base M9. The toner base M9 had a volume-average particle size of 5.2 μm and a coefficient of variation of 17.8.

(10) Preparation of Toner Base M10

In a 2000 ml four-neck flask equipped with a cooling tube and a thermometer were placed 204 g of resin particle dispersion RL3, 20 g of colorant particle dispersion PM1 (20 wt % concentration), 10 g of wax particle dispersion WA2 (30 wt % concentration), 40 g of wax particle dispersion WA9 (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 11.4 by adding 1N NaOH to the mixed particle dispersion. Subsequently, 200 g of magnesium sulfate aqueous solution (30% concentration) was added and stirred for 10 minutes. After the temperature was raised from 22° C. to 75° C. at a rate of 5° C./min, the mixture was heat-treated at 75° C. for 1 hour. Then, the temperature was raised to 95° C., and the mixture further was heat-treated for 4 hours to provide aggregated and associated particles with a volume-average particle size of 4.1 μm and a coefficient of variation of 18.9. The proportion of the second particles was 78% by number.

After the water temperature was reduced to 60° C., the pH was adjusted to 8.0, and 43 g of resin particle dispersion RH5 (20 wt % concentration) for forming a shell was added, followed by 43 g of magnesium sulfate aqueous solution (30% concentration). This mixture was heated at 75° C. for 0.5 hours, and then was heated at 90° C. for 3 hours. The pH was adjusted to 5.0 by the addition of 1N HCl, and the mixture further was heated at 95° C. for 2 hours. After cooling, the reaction product (toner base) was filtered and washed three times with ion-exchanged water. The toner base thus obtained was dried at 40° C. for 6 hours by using a fluid-type dryer, resulting in a toner base M10. The toner base M10 had a volume-average particle size of 5.5 μm and a coefficient of variation of 16.8.

(11) Preparation of Toner Base M11

In a 2000 ml four-neck flask equipped with a cooling tube and a thermometer were placed 204 g of resin particle dispersion RL2, 20 g of colorant particle dispersion PM1 (20 wt % concentration), 25 g of wax particle dispersion WA8 (30 wt % concentration), 25 g of wax particle dispersion WA9 (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 11.0 by adding 1N NaOH to the mixed particle dispersion. Subsequently, 200 g of magnesium sulfate aqueous solution (30% concentration) was added and stirred for 10 minutes. After the temperature was raised from 22° C. to 75° C. at a rate of 5° C./min, the mixture was heat-treated at 75° C. for 1 hour. Then, the temperature was raised to 97° C., and the mixture further was heat-treated for 3 hours to provide aggregated and associated particles with a volume-average particle size of 4.4 μm and a coefficient of variation of 21.9. The proportion of the second particles was 52% by number.

After the water temperature was reduced to 60° C., the pH was adjusted to 8.0, and 43 g of resin particle dispersion RH5 (20 wt % concentration) for forming a shell was added, followed by 43 g of magnesium sulfate aqueous solution (30% concentration). This mixture was heated at 75° C. for 0.5 hours, and then was heated at 90° C. for 3 hours. The pH was adjusted to 5.0 by the addition of 1N HCl, and the mixture further was heated at 95° C. for 2 hours. After cooling, the reaction product (toner base) was filtered and washed three times with ion-exchanged water. The toner base thus obtained was dried at 40° C. for 6 hours by using a fluid-type dryer, resulting in a toner base M11. The toner base M11 had a volume-average particle size of 5.9 μm and a coefficient of variation of 19.7.

(12) Preparation of Toner Base m12

In a 2000 ml four-neck flask equipped with a cooling tube and a thermometer were placed 204 g of resin particle dispersion RL2, 20 g of colorant particle dispersion PM1 (20 wt % concentration), 50 g of wax particle dispersion wa10 (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 7.5 by adding 1N NaOH to the mixed particle dispersion. Subsequently, 200 g of magnesium sulfate aqueous solution (30% concentration) was added and stirred for 10 minutes. After the temperature was raised from 22° C. to 92° C. at a rate of 5° C./min, the mixture was heat-treated at 92° C. for 2 hours. Then, the temperature was raised to 95° C., and the mixture further was heat-treated for 5 hours to provide aggregated and associated particles. After cooling, the reaction product (toner base) was filtered and washed three times with ion-exchanged water. The toner base thus obtained was dried at 40° C. for 6 hours by using a fluid-type dryer, resulting in a toner base m12. The observation with a Coulter Counter (Multisizer 2 manufactured by Coulter Electronics, Inc.) showed that the toner base m12 had a volume-average particle size of 14.5 μm and a coefficient of variation of 28.8. The proportion of the second particles formed of the resin and the wax in the mixed and dispersed state was 42% by number.

(13) Preparation of Toner Base m13

In a 2000 ml four-neck flask equipped with a cooling tube and a thermometer were placed 204 g of resin particle dispersion RL2, 20 g of colorant particle dispersion PM1 (20 wt % concentration), 50 g of wax particle dispersion wall (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 7.5 by adding 1N NaOH to the mixed particle dispersion. Subsequently, 200 g of magnesium sulfate aqueous solution (30% concentration) was added and stirred for 10 minutes. After the temperature was raised from 22° C. to 96° C. at a rate of 5° C./min, the mixture was heat-treated at 96° C. for 6 hours to provide aggregated and associated particles. After cooling, the reaction product (toner base) was filtered and washed three times with ion-exchanged water. The toner base thus obtained was dried at 40° C. for 6 hours by using a fluid-type dryer, resulting in a toner base m13. The toner base m13 had a volume-average particle size of 13.9 μm and a coefficient of variation of 29.0. Thus, the particle size distribution became broader. The proportion of the second particles was 38% by number.

(14) Preparation of Toner Base m14

In a 2000 ml four-neck flask equipped with a cooling tube and a thermometer were placed 204 g of resin particle dispersion RL2, 20 g of colorant particle dispersion PM1 (20 wt % concentration), 50 g of wax particle dispersion wa12 (30 wt % concentration), and 200 ml of ion-exchanged water, and then mixed for 10 minutes by using a homogenizer (Ultratalax T50 manufactured by IKA CO., LTD.). Thus, a mixed particle dispersion was prepared.

The pH was adjusted to 8 by adding 1N NaOH to the mixed particle dispersion. Subsequently, 200 g of magnesium sulfate aqueous solution (30% concentration) was added and stirred for 10 minutes. After the temperature was raised from 22° C. to 95° C. at a rate of 5° C./min, the mixture was heat-treated at 95° C. for 3 hours to provide aggregated and associated particles. After cooling, the reaction product (toner base) was filtered and washed three times with ion-exchanged water. The toner base thus obtained was dried at 40° C. for 6 hours by using a fluid-type dryer, resulting in a toner base m14. The toner base m14 had a volume-average particle size of 13.6 μm and a coefficient of variation of 32.1. Thus, the particle size distribution became much broader. The proportion of the second particles was 42% by number.

(15) Preparation of Toner Base m15

A toner base m15 was prepared under the same conditions as the toner base m14 except that the pH was 13 and the temperature was 75° C. The toner base m15 had a volume-average particle size of 2.1 μm and a coefficient of variation of 42.8, which led to a broad particle size distribution. Moreover, many wax particles were suspended, and the particles were not formed successfully.

Table 8 shows the additives used in this example. The amount of charge was measured by a blow-off method using frictional charge with an uncoated ferrite carrier. Under the environmental conditions of 25° C. and 45% RH, 50 g of carrier and 0.1 g of silica or the like were mixed in a 100 ml polyethylene container, and then stirred by vertical rotation at a speed of 100 $min^{-1}$ for 5 minutes and 30 minutes, respectively. Thereafter, 0.3 g of sample was taken for each stirring time, and a nitrogen gas was blown on the samples at $1.96\times10^4$ (Pa) for 1 minute.

It is preferable that the 5-minute value is −100 to −800 μC/g and the 30-minute value is −50 to −600 μC/g for the negative chargeability. Silica having a high charge amount can function well in a small quantity.

TABLE 8

| Inorganic fine powder | Material | Treatment material A | Treatment material B | Particle size (nm) | Methanol titration (%) | Moisture absorption | Ignition loss (wt %) | Drying loss (wt %) | 5-min value | 30-min value | 5-min/ 30-min value |
|---|---|---|---|---|---|---|---|---|---|---|---|
| S1 | Silica | Silica treated with dimethylpolysiloxane | | 6 | 88 | 0.1 | 10.5 | 0.2 | −820 | −710 | 86.6 |
| S2 | Silica | Silica treated with methyl hydrogen polysiloxane | | 16 | 88 | 0.1 | 5.5 | 0.2 | −560 | −450 | 80.4 |
| S3 | Silica | Methyl hydrogen polysiloxane (1) | | 40 | 88 | 0.1 | 10.8 | 0.2 | −580 | −480 | 82.8 |
| S4 | Silica | Dimethylpolysiloxane (20) | Zinc octoate (1) | 40 | 84 | 0.09 | 24.5 | 0.2 | −740 | −580 | 78.4 |
| S5 | Silica | Methyl hydrogen polysiloxane (1) | Aluminium distearate (2) | 40 | 88 | 0.1 | 10.8 | 0.2 | −580 | −480 | 82.8 |
| S6 | Silica | Dimethylpolysiloxan (2) | Stearic acid amide (1) | 80 | 88 | 0.12 | 15.8 | 0.2 | −620 | −475 | 76.6 |
| S7 | Silica | Methyl hydrogen polysiloxane (1) | Fatty acid pentaerythritol monoester (1) | 150 | 88 | 0.10 | 5.8 | 0.2 | −510 | −420 | 82.3 |
| S8 | Titanium oxide | Diphenylpolysiloxan (10) | Sodium stearate (1) | 80 | 88 | 0.1 | 18.5 | 0.2 | −750 | −650 | 86.7 |
| S9 | Silica | Silica treated with hexamethyldisilazane | | 16 | 68 | 0.60 | 1.6 | 0.2 | −800 | −620 | 77.5 |

Table 9 shows the toner material compositions used in this example. The compositions of black toner, cyan toner, and yellow toner were the same as the composition of magenta toner except for pigment, i.e., PB1, PC1, and PY1 were used for the black toner, the cyan toner, and the yellow toner, respectively.

TABLE 9

| Toner | Toner base | Additive A | Additive B |
|---|---|---|---|
| TM1 | M1 | S1(0.6) | S3(2.5) |
| TM2 | M2 | S2(1.8) | S4(1.5) |
| TM3 | M3 | S1(1.8) | S5(2.2) |
| TM4 | M4 | S2(2.5) | |
| TM5 | M5 | S1(2.0) | S6(2.0) |
| TM6 | M6 | S2(1.8) | S7(3.5) |
| TM7 | M7 | S1(0.6) | S8(2.0) |
| TM8 | M8 | S1(1.0) | S6(2.5) |
| TM9 | M9 | S2(1.8) | S7(3.5) |
| TM10 | M10 | S1(0.6) | S8(2.0) |
| TM11 | M11 | S2(1.2) | S3(1.5) |
| tm12 | m12 | S9(0.5) | |

TABLE 9-continued

| Toner | Toner base | Additive A | Additive B |
|---|---|---|---|
| tm13 | m13 | S9(0.5) | |
| tm14 | m14 | S9(0.5) | |

The numbers in the parentheses indicate the amount (parts by weight) of the additive per 100 parts by weight of the toner base. The addition treatment was performed by using FM20B with a Z0S0-type mixer blade, an input amount of 1 kg, a number of revolutions of 2000 $min^{-1}$, and a treating time of 5 minutes.

FIG. 1 is a cross-sectional view showing the configuration of a full color image forming apparatus used in this example. In FIG. 1, the outer housing of a color electrophotographic printer is not shown.

A transfer belt unit 17 includes a transfer belt 12, a first color (yellow) transfer roller 10Y, a second color (magenta) transfer roller 10M, a third color (cyan) transfer roller 10C, a fourth color (black) transfer roller 10K, a driving roller 11 made of aluminum, a second transfer roller 14 made of an elastic body, a second transfer follower roller 13, a belt cleaner blade 16 for cleaning a toner image that remains on the transfer belt 12, and a roller 15 located opposite to the belt cleaner blade 16. The first to fourth color transfer rollers 10Y, 10M, 10C, and 10K are made of an elastic body.

A distance between the first color (Y) transfer position and the second color (M) transfer position is 70 mm (which is the same as a distance between the second color (M) transfer position and the third color (C) transfer position and a distance between the third color (C) transfer position and the fourth color (K) transfer position). The circumferential velocity of a photoconductive member is 125 mm/s.

The transfer belt 12 can be obtained by kneading a conductive filler in an insulating resin and making a film with an extruder. In this example, polycarbonate resin (e.g., European Z300 manufactured by Mitsubishi Gas Kagaku Co., Ltd.) was used as the insulating resin, and 5 parts by weight of conductive carbon (e.g., "KETJENBLACK") were added to 95 parts by weight of the polycarbonate resin to form a film. The surface of the film was coated with a fluorocarbon resin. The film had a thickness of about 100 μm, a volume resistance of $10^7$ to $10^{12}$ Ω·cm, and a surface resistance of $10^7$ to $10^{12}$ Ω/□ (square). The use of this film can improve the dot reproducibility and prevent slackening of the transfer belt 12 over a long period of use or charge accumulation effectively. By coating the film surface with a fluorocarbon resin, the filming of toner on the surface of the transfer belt 12 due to a long period of use also can be suppressed effectively. When the volume resistance is less than $10^7$ Ω·cm, retransfer is likely to occur. When the volume resistance is more than $10^{12}$ Ω·cm, the transfer efficiency is degraded.

A first transfer roller 10 is a urethane foam roller of conductive carbon and has an outer diameter of 8 mm. The resistance value is $10^2$ to $10^6$Ω. In the first transfer operation, the first transfer roller 10 is pressed against a photoconductive member 1 with a force of about 1.0 to 9.8 (N) via the transfer belt 12, so that the toner is transferred from the photoconductive member 1 to the transfer belt 12. When the resistance value is less than $10^2$Ω, retransfer is likely to occur. When the resistance value is more than $10^6$Ω, a transfer failure is likely to occur. The force less than 1.0 (N) may cause a transfer failure, and the force more than 9.8 (N) may cause transfer voids.

The second transfer roller 14 is a urethane foam roller of conductive carbon and has an outer diameter of 10 mm. The resistance value is $10^2$ to $10^6$Ω. The second transfer roller 14 is pressed against the follower roller 13 via the transfer belt 12 and a transfer medium 19 such as a paper or OHP sheet. The follower roller 13 is rotated in accordance with the movement of the transfer belt 12. In the second transfer operation, the second transfer roller 14 is pressed against the follower roller 13 with a force of 5.0 to 21.8 (N), so that the toner is transferred from the transfer belt 12 to the transfer medium 19. When the resistance value is less than $10^2$Ω, retransfer is likely to occur. When the resistance value is more than $10^6$Ω, a transfer failure is likely to occur. The force less than 5.0 (N) may cause a transfer failure, and the force more than 21.8 (N) may increase the load and generate jitter easily.

Four image forming units 18Y, 18M, 18C, and 18K for yellow (Y), magenta (M), cyan (C), and black (K) are arranged in series, as shown in FIG. 1.

The image forming units 18Y, 18M, 18C, and 18K have the same components except for a developer contained therein. For simplification, only the image forming unit 18Y for yellow (Y) will be described, and an explanation of the other units will not be repeated.

The image forming unit is configured as follows. Reference numeral 1 is a photoconductive member, 3 is pixel laser signal light, and 4 is a developing roller of aluminum that has an outer diameter of 10 mm and includes a magnet with a magnetic force of 1200 gauss. The developing roller 4 is located opposite to the photoconductive member 1 with a gap of 0.3 mm between them, and rotates in the direction of the arrow. A stirring roller 6 stirs toner and a carrier in a developing unit and supplies the toner to the developing roller 4. The mixing ratio of the toner to the carrier is read from a permeability sensor (not shown), and the toner is supplied timely from a toner hopper (not shown). A magnetic blade 5 is made of metal and controls a magnetic brush layer of a developer on the developing roller 4. In this example, 150 g of developer was introduced, and the gap was 0.4 mm. Although a power supply is not shown in FIG. 1, a direct voltage of −500 V and an alternating voltage of 1.5 kV (p-p) at a frequency of 6 kHz were applied to the developing roller 4. The circumferential velocity ratio of the photoconductive member 1 to the developing roller 4 was 1:1.6. The mixing ratio of the toner to the carrier was 93:7. The amount of developer in the developing unit was 150 g.

A charging roller 2 is made of epichlorohydrin rubber and has an outer diameter of 10 mm. A direct-current bias of −1.2 kV is applied to the charging roller 2 for charging the surface of the photoconductive member 1 to −600 V. Reference numeral 8 is a cleaner, 9 is a waste toner box, and 7 is a developer.

A paper is conveyed from the lower side of the transfer belt unit 17, and a paper conveying path is formed so that a paper 19 is transported by a paper feed roller (not shown) to a nip portion where the transfer belt 12 and the second transfer roller 14 are pressed against each other.

The toner is transferred from the transfer belt 12 to the paper 19 by +1000 V applied to the second transfer roller 14, and then is conveyed to a fixing portion in which the toner is fixed. The fixing portion includes a fixing roller 201, a pressure roller 202, a fixing belt 203, a heat roller 204, and an induction heater 205.

Figure 2:
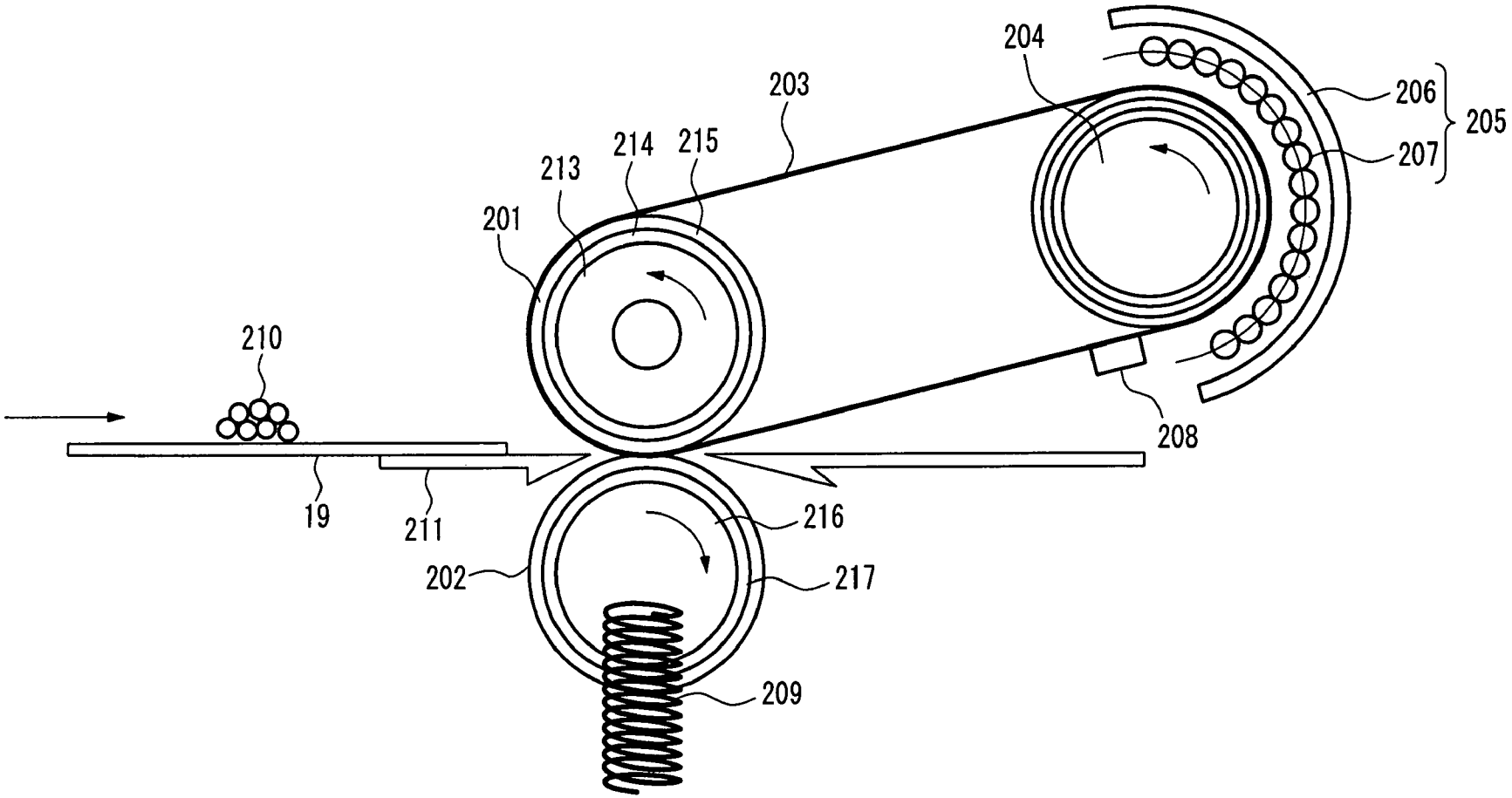
FIG. 2 is a cross-sectional view showing the configuration of a fixing unit used in an example of the present invention.

FIG. 2 shows a fixing process. A belt 203 runs between the fixing roller 201 and the heat roller 204. A predetermined load is applied between the fixing roller 201 and the pressure roller 202 so that a nip is formed between the belt 203 and the pressure roller 202. The induction heater 205 including a ferrite core 206 and a coil 207 is provided on the periphery of the heat roller 204, and a temperature sensor 208 is arranged on the outer surface.

The belt 203 is formed by arranging a Ni substrate (30 μm), silicone rubber (150 μm), and PFA (tetrafluoroethylene-perfluoroalkyl vinyl ether copolymer) (30 μm) in layers.

The pressure roller 202 is pressed against the fixing roller 201 by a spring 209. A recording material 19 with the toner 210 is moved along a guide plate 211.

The fixing roller 201 (fixing member) includes a hollow core 213, an elastic layer 214 formed on the hollow core 213, and a silicone rubber layer 215 formed on the elastic layer 214. The hollow core 213 is made of aluminum and has a length of 250 mm, an outer diameter of 14 mm, and a thickness of 1 mm. The elastic layer 214 is made of silicone rubber with a rubber hardness (JIS-A) of 20 degrees based on the JIS standard and has a thickness of 3 mm. The silicone rubber layer 215 has a thickness of 3 mm. Therefore, the outer diameter of the fixing roller 201 is about 26 mm. The fixing roller 201 is rotated at 125 mm/s by receiving a driving force from a driving motor (not shown).

The heat roller 204 includes a hollow pipe having a thickness of 1 mm and an outer diameter of 20 mm. The surface temperature of the fixing belt is controlled to 170° C. by using a thermistor.

The pressure roller 202 (pressure member) has a length of 250 mm and an outer diameter of 20 mm, and includes a hollow core 216 and an elastic layer 217 formed on the hollow core 216. The hollow core 216 is made of aluminum and has an outer diameter of 16 mm and a thickness of 1 mm. The elastic layer 217 is made of silicone rubber with a rubber hardness (JIS-A) of 55 degrees based on the JIS standard and has a thickness of 2 mm. The pressure roller 202 is mounted rotatably, and a 5.0 mm width nip is formed between the pressure roller 202 and the fixing roller 201 under a one-sided load of 147N given by the spring 209.

The operations will be described below. In the full color mode, all the first transfer rollers 10 of Y, M, C, and K are lifted and pressed against the respective photoconductive members 1 of the image forming units via the transfer belt 12. At this time, a direct-current bias of +800 V is applied to each of the first transfer rollers 10. An image signal is transmitted through the laser beam 3 and enters the photoconductive member 1 whose surface has been charged by the charging roller 2, thus forming an electrostatic latent image. The electrostatic latent image formed on the photoconductive member 1 is made visible by the toner on the developing roller 4 that is rotated in contact with the photoconductive member 1.

In this case, the image formation rate (125 mm/s, which is equal to the circumferential velocity of the photoconductive member) of the image forming unit 18Y is set so that the speed of the photoconductive member is 0.5 to 1.5% slower than the traveling speed of the transfer belt 12.

In the image forming process, signal light 3Y is input to the image forming unit 18Y, and an image is formed with Y toner. At the same time as the image formation, the Y toner image is transferred from the photoconductive member 1Y to the transfer belt 12 by the action of the first transfer roller 10Y, to which a direct voltage of +800 V is applied.

There is a time lag between the first transfer of the first color (Y) and the first transfer of the second color (M). Then, signal light 3M is input to the image forming unit 18M, and an image is formed with M toner. At the same time as the image formation, the M toner image is transferred from the photoconductive member 1M to the transfer belt 12 by the action of the first transfer roller 10M. In this case, the M toner is transferred onto the first color (Y) toner that has been formed on the transfer belt 12. Subsequently, the C (cyan) toner and K (black) toner images are formed in the same manner and transferred by the action of the first transfer rollers 10C and 10K. Thus, YMCK toner images are formed on the transfer belt 12. This is a so-called tandem process.

A color image is formed on the transfer belt 12 by superimposing the four color toner images in registration. After the last transfer of the K toner image, the four color toner images are transferred collectively to the paper 19 fed by a feeding cassette (not shown) at matched timing by the action of the second transfer roller 14. In this case, the follower roller 13 is grounded, and a direct voltage of +1 kV is applied to the second transfer roller 14. The toner images transferred to the paper 19 are fixed by a pair of fixing rollers 201 and 202. Then, the paper 19 is ejected through a pair of ejecting rollers (not shown) to the outside of the apparatus. The toner that is not transferred and remains on the transfer belt 12 is cleaned by the belt cleaner blade 16 to prepare for the next image formation.

Table 10 shows the results of visual images formed by the electrophotographic apparatus in FIG. 1. In Table 11, a transfer failure in the character portion of a full color image with three colors (magenta, cyan, and yellow) of toner and the winding of a paper around the fixing belt were evaluated.

The amount of charge was measured by a blow-off method using frictional charge with a ferrite carrier. Under the environmental conditions of 25° C. and 45% RH, 0.3 g of sample was taken to evaluate the durability, and a nitrogen gas was blown on the sample at $1.96\times10^4$ (Pa) for 1 minute.

TABLE 10

| Developer | Toner | Carrier | Filming on photoconductive member | Image density (ID) initial/after test | Fog | Uniformity of solid image | Transfer skipping in characters | Reverse transfer | Transfer voids |
|---|---|---|---|---|---|---|---|---|---|
| DM11 | TM1 | A4 | Not occur | 1.45/1.48 | ○ | ○ | ○ | ○ | ○ |
| DM12 | TM2 | A1 | Not occur | 1.42/1.41 | ○ | ○ | ○ | ○ | ○ |
| DM13 | TM3 | A3 | Not occur | 1.48/1.52 | ○ | ○ | ○ | ○ | ○ |
| DM14 | TM4 | A2 | Not occur | 1.41/1.40 | ○ | ○ | ○ | ○ | ○ |
| DM15 | TM5 | A4 | Not occur | 1.52/1.49 | ○ | ○ | ○ | ○ | ○ |
| DM16 | TM6 | A1 | Not occur | 1.38/1.39 | ○ | ○ | ○ | ○ | ○ |
| DM17 | TM7 | A1 | Not occur | 1.37/1.38 | ○ | ○ | ○ | ○ | ○ |
| DM18 | TM8 | A1 | Not occur | 1.44/1.42 | ○ | ○ | ○ | ○ | ○ |
| DM19 | TM9 | A2 | Not occur | 1.43/1.42 | ○ | ○ | ○ | ○ | ○ |
| DM20 | TM10 | A3 | Not occur | 1.48/1.49 | ○ | ○ | ○ | ○ | ○ |
| DM21 | TM11 | A4 | Not occur | 1.33/1.31 | ○ | ○ | ○ | ○ | ○ |
| cm1 | TM1 | b2 | Not occur | 1.46/1.22 | ○ | Δ | ○ | ○ | ○ |
| cm2 | TM3 | b3 | Not occur | 1.47/1.21 | ○ | Δ | ○ | ○ | ○ |
| cm3 | TM4 | b1 | Not occur | 1.37/1.29 | ○ | Δ | ○ | ○ | ○ |
| cm4 | tm12 | b4 | Occur | 1.48/1.09 | x | x | x | x | x |
| cm5 | tm13 | b1 | Occur | 1.52/1.21 | x | x | x | x | x |
| cm6 | tm14 | b2 | Occur | 1.48/1.11 | x | x | x | x | x |

TABLE 11

| Toner | OHP transmittance (%) | High-temperature offset generation (° C.) | Storage stability test | Winding around fixing belt | Toner disturbance during fixing |
|---|---|---|---|---|---|
| TM1 | 92.5 | 210 | ○ | Not occur | None |
| TM2 | 81.8 | 240 | ○ | Not occur | None |
| TM3 | 91.8 | 210 | ○ | Not occur | None |
| TM4 | 80.9 | 240 | ○ | Not occur | None |
| TM5 | 92.8 | 210 | ○ | Not occur | None |
| TM6 | 81.5 | 240 | ○ | Not occur | None |
| TM7 | 82.8 | 240 | ○ | Not occur | None |
| TM8 | 84.5 | 240 | ○ | Not occur | None |
| TM9 | 82.4 | 240 | ○ | Not occur | None |
| TM10 | 81.2 | 240 | ○ | Not occur | None |
| TM11 | 80.4 | 240 | ○ | Not occur | None |
| tm12 | 71.2 | 190 | x | Occur | Scattering |
| tm13 | 72.9 | 180 | x | Occur | Scattering |
| tm14 | 71.8 | 190 | x | Occur | Scattering |

When visual images were formed by using a developer, there was no disturbance in horizontal lines, no scattering toner, and no transfer void. The black solid images were uniform, and images with significantly high resolution and high quality were reproduced even at 16 lines per millimeter. Moreover, high-density images having an image density of not less than 1.3 were obtained. Further, no background fog was present in the non-image portions. In the long period durability test after 100,000 copies of A4 paper, the flowability and the image density were not changed very much, and the characteristics were stable. The solid images in development also had favorable uniformity, and a developing memory was not generated. Moreover, unusual images with vertical strips did not occur over continuous use. There was almost no spent of the toner components on the carrier. A change in carrier resistance was reduced, a decrease in charge amount was suppressed, and no fog was caused. The charge build-up property was good even after quick supply of the toner. Fog was not increased under high humidity conditions. Moreover, high saturation charge was maintained over a long period of use. The amount of charge hardly varied under low temperature and low humidity. The transfer voids were not a problem for practical use, and the transfer efficiency was about 95%. The filming of the toner on the photoconductive member or the transfer belt also was not a problem for practical use. A cleaning failure of the transfer belt did not occur. There was almost no disturbance or scattering of the toner during fixing. In the case of a full color image formed by superimposing three colors, a transfer failure did not occur, and a paper was not wound around the fixing belt.

When the developers cm1, cm2, and cm3 were used at a process speed of 100 mm/s while the photoconductive members were spaced 70 mm apart, the transfer voids, skipping in characters during transfer, and reverse transfer were acceptable levels, and the solid images had good uniformity. However, when the process speed was increased to 125 mm/s or the distance between the photoconductive members was 60 mm, the solid image uniformity was somewhat reduced.

For the developers cm4, cm5, and cm6, the charge was raised, the image density was reduced, and considerable fog was generated. Moreover, when the solid images were developed continuously by two-component development, and then the toner was supplied quickly, the charge was reduced, and fog was increased. This phenomenon became worse, particularly under high humidity conditions. The transfer voids, skipping in characters during transfer, and reverse transfer occurred and were not acceptable levels for practical use. The filming of the toner on the photoconductive member and fog also occurred considerably. Moreover, spent of the toner on the carrier was increased, and the carrier resistance was changed significantly. Further, the amount of charge was decreased, and fog was likely to be larger. Under high temperature and high humidity conditions, fog was increased due to a reduction in charge amount. Under low temperature and low humidity conditions, the image density was reduced due to an increase in charge amount. The transfer efficiency was lowered to about 60% to 70%. In addition, the filming of the toner on the transfer belt or a cleaning failure was caused. The solid images became blurred at the end of the development. The wax adhered to the developing blade, and unusual images with vertical strips were formed over continuous use. In outputting an image of three superimposed colors, a paper was wound around the fixing belt. The toner scattered during fixing.

Next, a solid image was fixed in an amount of 1.2 mg/cm$^2$ at a process speed of 125 mm/s by using a fixing device provided with an oilless belt, and the OHP transmittance (fixing temperature: 160° C.), the offset resistance at high temperatures, and the fixability at low temperatures were evaluated. The low-temperature fixability indicates the minimum temperature at which cold offset does not occur. The OHP transmittance was measured with 700 nm light by using a spectrophotometer (U-3200 manufactured by Hitachi, Ltd.). The storage stability was evaluated after being left standing at 50° C. for 24 hours.

Paper jam did not occur in the nip portion. When a green solid image was fixed on a plain paper, no offset occurred until 200,000 copies. Even if a silicone or fluorine-based fixing belt was used without oil, the surface of the belt did not wear. The OHP transmittance was not less than 80%. The temperature range of offset resistance was increased by using the fixing roller without oil. Moreover, agglomeration hardly was observed under the storage conditions of 50° C. for 24 hours (indicated by ○). For the toners tm12, tm13, and tm14, however, solidification occurred during the storage stability test, the low-temperature fixability was reduced, and the high-temperature offset resistance was degraded.

INDUSTRIAL APPLICABILITY

The present invention is useful not only for an electrophotographic system including a photoconductive member, but also for a printing system in which the toner adheres directly on a paper.

The invention claimed is:

1. Toner comprising:

aggregated and associated particles formed by mixing in an aqueous medium at least a resin particle dispersion in which resin particles are dispersed, a colorant particle dispersion in which colorant particles are dispersed, and a wax particle dispersion in which wax particles are dispersed and heat-treating the mixed dispersion for aggregation, wherein the aggregated and associated particles comprise first particles having a capsule structure in which aggregated wax with an average particle size of greater than 1 μm is incorporated into the resin, and second particles formed of the resin and the wax in a mixed and dispersed state.

2. The toner according to claim 1, wherein a resin particle dispersion in which resin particles for forming a shell are dispersed is added to the dispersion after the aggregated and associated particles are formed, and then is heat-treated so that the resin particles for forming a shell are fused with the aggregated and associated particles to form fused particles, and the fused particles comprise at least 0.1 μm thick coating of the resin particles for forming a shell that covers surfaces of the aggregated and associated particles of the resin particles, the colorant particles, and the wax particles.

3. The toner according to claim 1, wherein a proportion of the second particles is not less than 50% by number.

4. The toner according to claim 1, wherein a proportion of the second particles is 50% to 80% by number.

5. The toner according to claim 1, wherein the wax particles in the wax particle dispersion are 20 nm to 200 nm for 16% diameter (PR16), 40 nm to 300 nm for 50% diameter (PR50), and not more than 400 nm for 84% diameter (PR84) in a cumulative volume particle size distribution obtained by accumulation from a smaller particle diameter side.

6. The toner according to claim 1, wherein 1.0 to 6 parts by weight of inorganic fine powder having an average particle size of 6 nm to 200 nm are added further to 100 parts by weight of a toner base.

7. The toner according to claim 1, wherein 0.5 to 2.5 parts by weight of inorganic fine powder having an average particle size of 6 nm to 20 nm and an ignition loss of 1.5 wt % to 25 wt %, and 0.5 to 3.5 parts by weight of inorganic fine powder having an average particle size of 20 nm to 200 nm and an ignition loss of 0.5 wt % to 23 wt % are added further to 100 parts by weight of a toner base.

8. A two-component developer comprising:

a toner base;

an additive; and a carrier, the toner base comprising aggregated and associated particles formed by mixing in an aqueous medium at least a resin particle dispersion in which resin particles are dispersed, a colorant particle dispersion in which colorant particles are dispersed, and a wax particle dispersion in which wax particles are dispersed and heat-treating the mixed dispersion for aggregation, wherein the toner base comprises first particles having a capsule structure in which aggregated wax with an average particle size of greater than 1 μm is incorporated into the resin, and second particles formed of the resin and the wax in a mixed and dispersed state, wherein the additive is inorganic fine powder with an average particle size of 6 nm to 200 nm and 1.0 to 6 parts by weight of the inorganic fine powder are added to 100 parts by weight of the toner base; and wherein the carrier comprises magnetic particles as a core material, and at least a surface of the core material is coated with a fluorine modified silicone resin containing an aminosilane coupling agent.

9. The two-component developer according to claim 8, wherein a resin particle dispersion in which resin particles for forming a shell are dispersed is added to the dispersion after the aggregated and associated particles are formed, and then is heat-treated so that the resin particles for forming a shell are fused with the aggregated and associated particles to form fused particles, and the fused particles comprise at least 0.1 μm thick coating of the resin particles for forming a shell that covers surfaces of the aggregated and associated particles of the resin particles, the colorant particles, and the wax particles.

10. The two-component developer according to claim 8, wherein a proportion of the second particles is not less than 50% by number.

11. The two-component developer according to claim 8, wherein a proportion of the second particles is 50% to 80% by number.

12. The two-component developer according to claim 8, wherein the wax particles in the wax particle dispersion are 20 nm to 200 nm for 16% diameter (PR 16), 40 nm to 300 nm for 50% diameter (PR5O), and not more than 400 nm for 84% diameter (PR84) in a cumulative volume particle size distribution obtained by accumulation from a smaller particle diameter side.

13. The two-component developer according to claim 8, wherein 1.0 to 6 parts by weight of inorganic fine powder having an average particle size of 6 nm to 150 nm are added further to 100 parts by weight of the toner base.

14. The two-component developer according to claim 8, wherein 0.6 to 2.5 parts by weight of inorganic fine powder having an average particle size of 6 nm to 20 nm, an ignition loss of 3 wt % to 15 wt %, and a drying loss of 0.01 wt % to 1.5 wt %, and 1.0 to 3.5 parts by weight of inorganic fine powder having an average particle size of 20 nm to 200 nm, an ignition loss of 3 wt % to 15 wt %, and a drying loss of 0.01 wt % to 1.5 wt % are added further to 100 parts by weight of the toner base.

15. The two-component developer according to claim 8, wherein 5 to 40 parts by weight of the aminosilane coupling agent are contained in 100 parts by weight of the coating resin of the carrier.

16. The two-component developer according to claim 8, wherein 1 to 15 parts by weight of conductive fine powder are contained in 100 parts by weight of the coating resin of the carrier.

17. The two-component developer according to claim 8, wherein the carrier comprises 0.1 to 5.0 parts by weight of the coating resin with respect to 100 parts by weight of the core material.

* * * * *